US009827474B2

(12) United States Patent
Sciandra

(10) Patent No.: US 9,827,474 B2
(45) Date of Patent: Nov. 28, 2017

(54) DISC THROWING GAME HAVING ILLUMINATION AND FLOTATION MEANS

(71) Applicant: Kan Jam, LLC, Williamsville, NY (US)

(72) Inventor: Charles C. Sciandra, Wheatfield, NY (US)

(73) Assignee: Kan Jam, LLC, Williamsville, NY (US)

( * ) Notice: Subject to any disclaimer, the term of this patent is extended or adjusted under 35 U.S.C. 154(b) by 0 days.

(21) Appl. No.: 14/991,591

(22) Filed: Jan. 8, 2016

(65) Prior Publication Data

US 2016/0121186 A1 May 5, 2016

Related U.S. Application Data

(63) Continuation-in-part of application No. 14/013,646, filed on Aug. 29, 2013, now abandoned.

(51) Int. Cl.
*A63B 67/06* (2006.01)
*A63B 67/00* (2006.01)
(Continued)

(52) U.S. Cl.
CPC ..... *A63B 67/06* (2013.01); *A63B 63/00* (2013.01); *A63B 67/007* (2013.01); *A63F 9/0204* (2013.01); *A63B 2207/02* (2013.01); *A63B 2209/10* (2013.01); *A63B 2210/50* (2013.01); *A63B 2225/605* (2013.01); *A63F 2250/205* (2013.01)

(58) Field of Classification Search
CPC ..... A63B 67/06; A63B 67/08; A63B 63/00; A63B 2207/02; A63B 2067/063; A63B 2225/605
USPC ..... 273/398–402, 350
See application file for complete search history.

(56) References Cited

U.S. PATENT DOCUMENTS 1,114,523 A 10/1914 Revell
3,350,097 A 10/1967 Chevrette et al.
(Continued)

FOREIGN PATENT DOCUMENTS

CA 2027388 A 4/1992
WO 9813110 A1 4/1998

OTHER PUBLICATIONS

Kan-Jam, Aug. 1, 2013, "KanJam Illuminate Glow in the Dark Accessory kit", Amazon.com, [online], Available from: http://wvvw.amazon.com/Kan-Illuminate-Glow-Dark-Accessory/dp/B008A1OB48fref=cm_cr_pr_producUop D [Accessed Jan. 14, 2015].

(Continued)

*Primary Examiner* — Mark Graham
(74) *Attorney, Agent, or Firm* — Simpson & Simpson, PLLC

(57) ABSTRACT

A disc throwing game including a receptacle including: an open top, an open bottom connected to the open top, and at least one aperture arranged between the open top and the open bottom, and an illumination means securable only to an inside surface of the receptacle a distance from the at least one aperture, the illumination means operatively arranged to transmit light through the at least one aperture and the open top. A disc throwing game assembly including two such receptacles and a disc shaped gliding object. A method of playing the disc throwing game.

16 Claims, 19 Drawing Sheets

(51) Int. Cl.

| | |
|---|---|
| ***A63F 9/02*** | (2006.01) |
| ***A63B 63/00*** | (2006.01) |

(56) References Cited

U.S. PATENT DOCUMENTS

| | | | | |
|---|---|---|---|---|
| 3,359,678 | A | 12/1967 | Headrick | |
| 3,403,907 | A | 10/1968 | Keller | |
| 3,469,844 | A | 9/1969 | Sindelar | |
| 4,114,885 | A | 9/1978 | Morrow | |
| 4,204,682 | A | 5/1980 | Brown | |
| 4,335,881 | A | 6/1982 | Warehime | |
| 4,982,966 | A | 1/1991 | Teafatiller | |
| 5,048,845 | A | 9/1991 | Dunipace | |
| 5,056,797 | A | 10/1991 | Hockert et al. | |
| 5,123,656 | A | 6/1992 | Green | |
| D333,896 | S | 3/1993 | Starkweather | |
| 5,354,067 | A | 10/1994 | Junemann | |
| 5,382,028 | A | 1/1995 | Sciandra et al. | |
| 5,896,693 | A | 4/1999 | Ray | |
| 6,889,982 | B1 | 5/2005 | Gove | |
| 6,971,940 | B2 | 12/2005 | Cohen et al. | |
| 7,134,662 | B2 | 11/2006 | Menendez | |
| 7,854,528 | B2 | 12/2010 | Segretto et al. | |
| 8,348,713 | B2 | 1/2013 | Groft et al. | |
| 8,807,569 | B1 | 8/2014 | Davis | |
| 8,967,624 | B1 | 3/2015 | Ingle | |
| 2002/0175469 | A1 | 11/2002 | Kessler, Jr. et al. | |
| 2004/0221885 | A1 | 11/2004 | Zheng | |
| 2006/0103072 | A1 | 5/2006 | Mercieca | |
| 2008/0111312 | A1 | 5/2008 | Longo et al. | |
| 2009/0069129 | A1 | 3/2009 | McCarthy | |
| 2010/0164175 | A1 | 7/2010 | Buchanan | |
| 2010/0317470 | A1 | 12/2010 | Cea et al. | |
| 2012/0065004 | A1 | 3/2012 | Blackwell | |
| 2013/0093139 | A1* | 4/2013 | Shea | A63F 9/02 273/354 |
| 2014/0183823 | A1 | 7/2014 | Deming et al. | |
| 2015/0061225 | A1 | 3/2015 | Sciandra | |

OTHER PUBLICATIONS

Kan-Jam, Jul. 21, 2009, "Kan Jam Ultimate Disc Game" Amazon.com, [online], Available from http://wvvw.amazon.com Kan-Jam 102863-Kan-Jam-Game/dp/BOOIRJ4Q2G/ref=cm_cr_pr product_top [Accessed Jan. 14, 2015].

* cited by examiner

DISC THROWING GAME HAVING ILLUMINATION AND FLOTATION MEANS

CROSS-REFERENCE TO RELATED APPLICATIONS

This patent application is filed under 35 U.S.C. §111(a) and §120 and is a continuation-in-part of U.S. Nonprovisional patent application Ser. No. 14/013,646, filed Aug. 29, 2013, which application is incorporated herein by reference in its entirety.

FIELD OF THE INVENTION

The invention relates generally to games, and more specifically, to disc throwing games which can be played in the dark and/or in a swimming pool.

BACKGROUND OF THE INVENTION

Disc throwing games are commonly played in basements, playrooms, backyards, front yards, playgrounds, and campgrounds. Traditionally, disc throwing games involve little time and effort in assembling and disassembling the game components making such games highly portable. Game components typically include one or more discs and one or more receptacles arranged as targets set up to receive the discs. Points can be earned when a disc is thrown into the target receptacle from a distance. However, these games often lack versatility, such as playing in the dark or in water. Unfortunately, a game can be prematurely cut short when the sun sets and/or the players can no longer see the target receptacles. As a result, consumers must purchase separate games to be played in lighted environments, other games to be played in the dark, and still other games to be played in the water.

One such backyard game, sold under the trademark Kan Jam®, is disclosed in U.S. Pat. No. 5,382,028 (Sciandra et al.) Sciandra et al. disclose an apparatus and method for playing a disc throwing game. The disc throwing game includes two targets, each having an open top and a slot proximate the top of each target. The game is played by placing the two targets a distance from each other. Each target faces the other. Players take turns throwing a disc toward each target, with each throw being scored. While this patented game has enjoyed wide commercial success, thus far, game play is limited to play during the day and on dry land.

U.S. Pat. No. 6,971,940 (Cohen et al.) discloses a throwing disc which has a solid circular shape containing a light source. Unfortunately, the light source requires an electrical input which can affect the longevity of the flying disc and the construction of the disc.

Finally, U.S. Pat. No. 8,348,713 (Groft et al.) discloses a flying disc formed of knotted filaments having a photo luminescent property. The disc described in the patent is flexible and designed for indoor use. Unfortunately, the disc is not designed for indoor and outdoor use in conjunction with a disc throwing game.

Therefore, there is a long-felt need for a versatile disc throwing game that can be played in the dark and/or in a swimming pool.

BRIEF SUMMARY OF THE INVENTION

The invention is a target for a disc throwing game including a receptacle including: an open top, an open bottom connected to the open top, and at least one aperture arranged between the open top and the open bottom, and an illumination means securable only to an inside surface of the receptacle a distance from the at least one aperture, the illumination means operatively arranged to transmit light through the at least one aperture and the open top.

In another embodiment, the invention comprises a target for a disc throwing game having at least one receptacle having a wall, the wall having at least one aperture therein, and a flotation member fixedly secured to the receptacle.

The invention is also a target for a disc throwing game having at least one receptacle having a wall, the wall having an inner surface and an outer surface, and at least one aperture therein, an illumination means secured to the inner surface of the wall, a first reflective member secured to the inner surface of the wall, operatively arranged to reflect light from the illumination means through the at least one aperture, and a flotation member fixedly secured to the receptacle.

The invention further includes a disc throwing game having two receptacles, a disc-shaped gliding object, and an illumination means within the receptacles, the illumination means including a plurality of reflective members secured to the inner surface of the walls of the receptacles. The reflective members are operatively arranged to reflect light.

The present invention also includes a disc throwing game assembly having a first receptacle having a wall, the wall having an inner surface and an outer surface, and at least one aperture therein. The invention further includes a second receptacle having a wall, the wall having an inner surface and an outer surface, and at least one aperture therein, a disc-shaped gliding object, a first flotation member fixedly secured to the first receptacle, and a second flotation member fixedly secured to the second receptacle.

In another embodiment, the invention includes a target for a disc throwing game having a receptacle having at least one aperture therein, and an illumination means secured to the receptacle operatively arranged to transmit light.

In a further embodiment, the invention comprises a method of playing a disc throwing game where the game is played by two players, a first player and a second player, having the steps of: (a) arranging a first receptacle and a second receptacle a distance apart wherein the receptacles face each other and each of the receptacles includes an aperture and an open top; (b) positioning the first player behind the first receptacle and the second player behind the second receptacle; (c) throwing a disc-shaped gliding object at the first receptacle by the second player; (d) tallying at least one point based on the throw by the second player if the disc-shaped gliding object hits the first receptacle directly; (e) declaring the second player a winner based on the throw by the second player if said disc-shaped gliding object lands inside the first receptacle; (f) throwing the disc-shaped gliding object at the second receptacle by the first player; (g) tallying at least one point based on the throw by the first player if the disc-shaped gliding object hits the second receptacle directly; (h) declaring the first player a winner based on the throw by the first player if the disc-shaped gliding object lands inside the receptacle; and, (i) repeating steps (c) through (h) in alternating fashion.

Accordingly, it is a primary object of the invention to have a disc throwing game that is versatile and can be played in a variety of outdoor settings or environments.

It is a further object of the invention to have a disc throwing game with two receptacles each having an open top, an open bottom, a slot, and a light source to enable gameplay at night.

Still another object of the invention to have a disc throwing game with two receptacles each having an open top, an open bottom, a slot, a means for flotation to enable gameplay in a pool.

These and other objects, features, and advantages of the present invention will become apparent in view of the following detailed description in view of the drawings and appended claims.

BRIEF DESCRIPTION OF THE DRAWINGS

The nature and mode of operation of the present invention will now be more fully described in the following detailed description of the invention taken with the accompanying figures, in which.

DETAILED DESCRIPTION OF THE INVENTION

At the outset, it should be appreciated that like drawing numbers on different drawing views identify identical, or functionally similar, structural elements of the invention. While the present invention is described with respect to what is presently considered to be the preferred aspects, it is to be understood that the invention as claimed is not limited to the disclosed aspect. The present invention is intended to include various modifications and equivalent arrangements within the spirit and scope of the appended claims.

Furthermore, it is understood that this invention is not limited to the particular methodology, materials and modifications described and as such may, of course, vary. It is also understood that the terminology used herein is for the purpose of describing particular aspects only, and is not intended to limit the scope of the present invention, which is limited only by the appended claims.

Unless defined otherwise, all technical and scientific terms used herein have the same meaning as commonly understood to one of ordinary skill in the art to which this invention belongs. Although any methods, devices or materials similar or equivalent to those described herein can be used in the practice or testing of the invention, the preferred methods, devices, and materials are now described.

Figure 1:
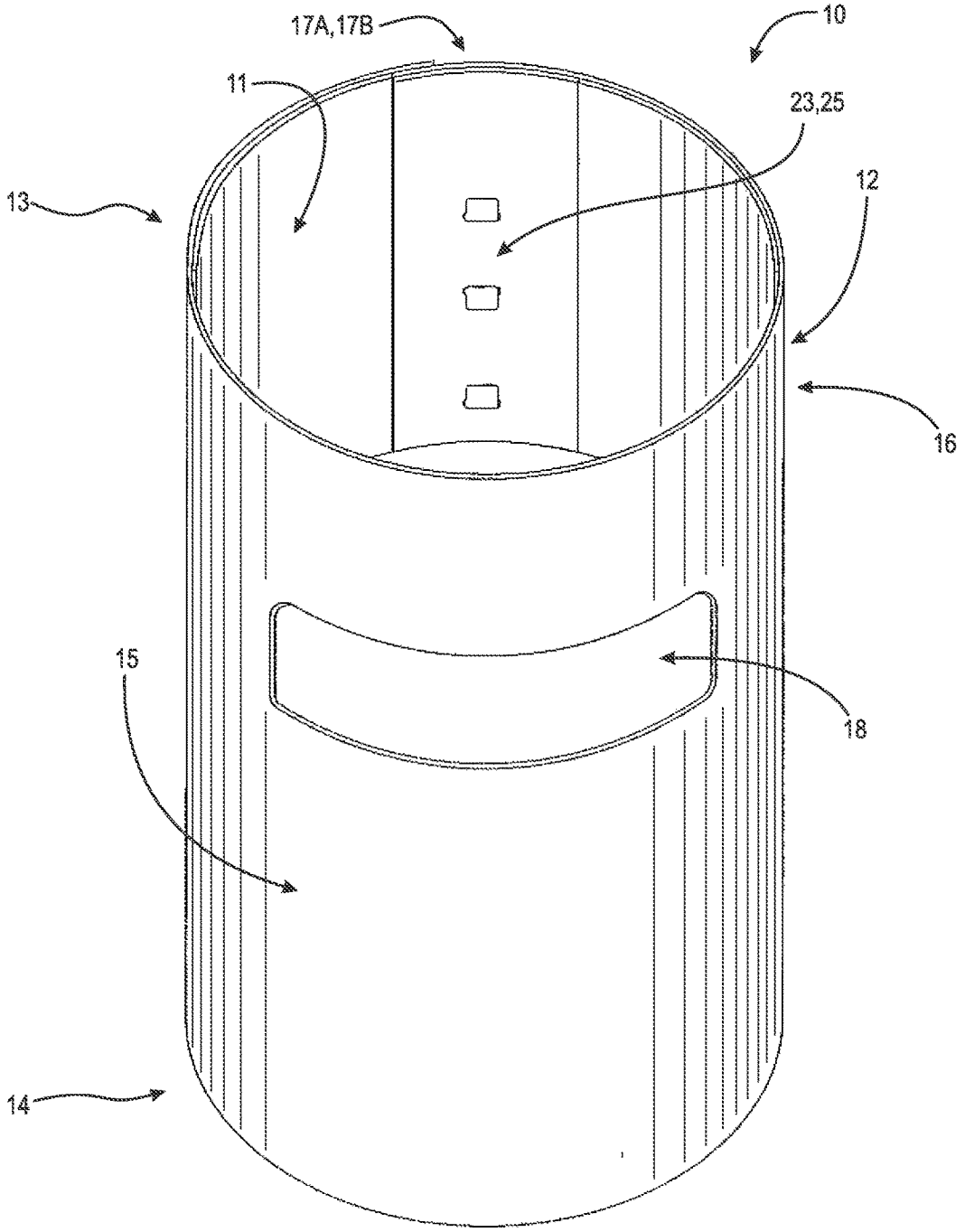
FIG. 1 is a perspective view of a target receptacle according to the invention.

Adverting now to the Figures, FIG. 1 depicts target receptacle 10 such as would be used with illumination assembly means 21 (not shown in FIG. 1) and/or flotation means 50 (not shown in FIG. 1), as will be described further below. In this embodiment, target receptacle 10 comprises inner wall 11, outer wall 12, first end 17A, and second end 17B. As will be described further below, target receptacle 10 forms a cylinder when ends 17A, 17B are rolled together and secured by tabs 23. Target receptacle 10 further comprises top 13, bottom 14, front 15, and rear 16. Top 13 and bottom 14 are open. Front 15 and rear 16 represent semi-cylindrical portions of target receptacle 10. Target receptacle 10 further comprises aperture 18. Preferably, aperture 18 is arranged proximate front 15 and top 13. It should be appreciated that target receptacle 10 could take any shape. For example, inner wall 11 and outer wall 12 of target receptacle 10 could be arranged to form a quadrilateral, a trapezoid, a polygon, or a frustoconical receptacle. Furthermore, target receptacle 10 could include a closed bottom while maintaining open top 13. In the preferred embodiment, target receptacle 10 has open top 13 and open bottom 14 so that target receptacle 10 is easily rolled-up for storage, packaging, and shipping. In order to roll-up target receptacle 10, tabs 23 are uncoupled from gaps 25 (to be described further below) of first end 17A. Furthermore, aperture 18 could form any shape, for example, an ellipsoid. Illumination assembly means 21 (not shown) is arranged within target receptacle 10.

Target receptacle 10 is cylindrical in shape and serves as the goal for a disc throwing game. In its preferred embodiment, target receptacle 10 is constructed of a pliable plastic film. The plastic film is durable, lightweight, bendable, and highly portable. Any material displaying these or similar qualities can be used to construct target receptacle 10, for example, fabric with a plastic or metal frame or a cardboard receptacle. Additionally, target receptacle 10 could be constructed of a hard plastic such that it cannot be rolled-up; eliminating the need for ends 17A, 17B.

Figure 2:
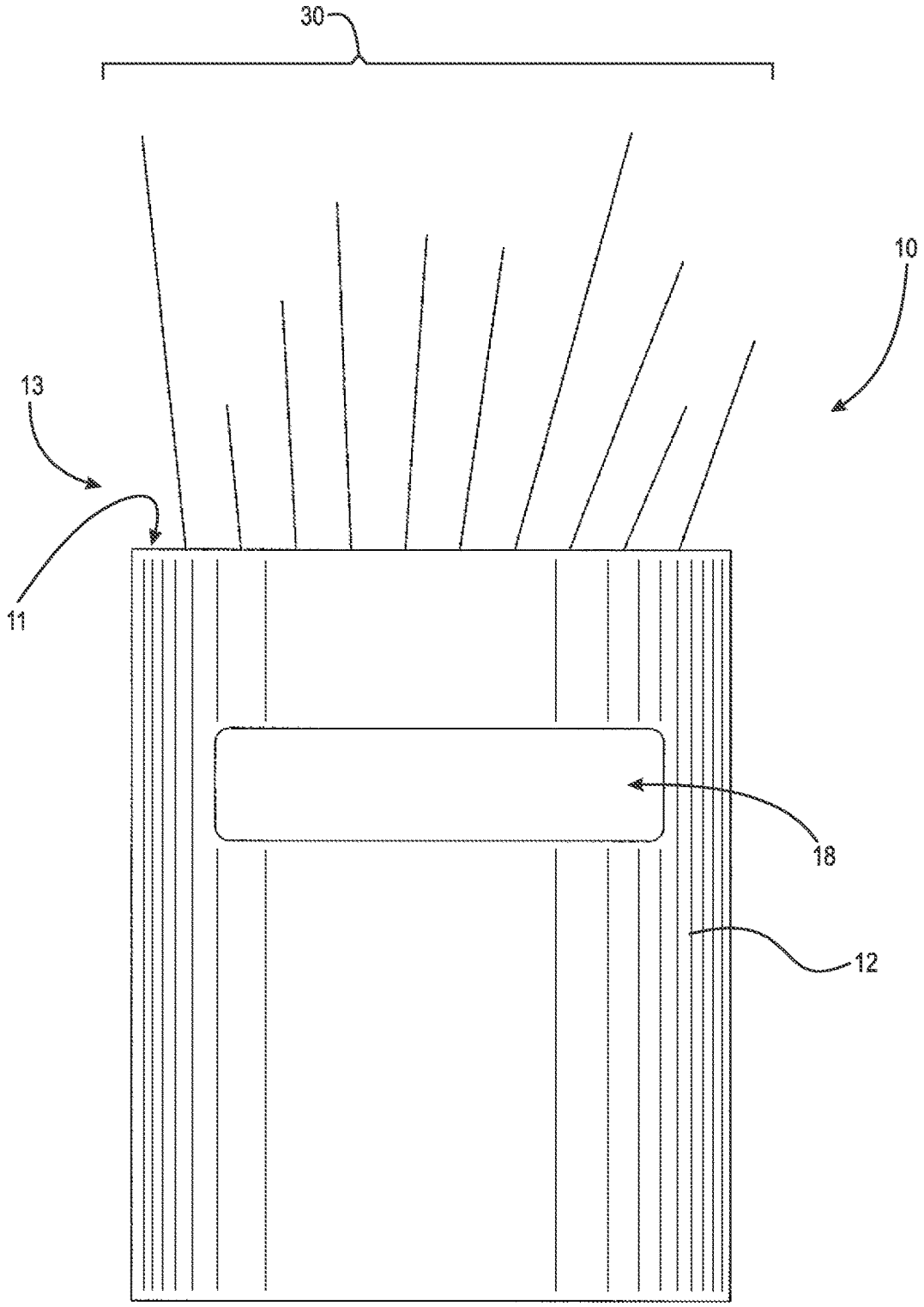
FIG. 2 is a front view of the target receptacle shown in FIG. 1 showing the illumination means in an activated mode.

FIG. 2 depicts the front view of target receptacle 10 as shown in FIG. 1. Aperture 18 is shaped as an open rectangular channel that is arcuate when target receptacle 10 is rolled together. Aperture 18 is correspondingly arcuate along the curvature of inner and outer walls 11, 12 of target receptacle 10. When illumination assembly means 21 (not shown) is activated, light emanates upwards from open top 13 and outwards through aperture 18 of target receptacle 10. For purposes of illustration, rays 30 represent typical light rays that are emitted from open top 13 when illumination assembly means 21 (not shown) is activated.

Figure 3:
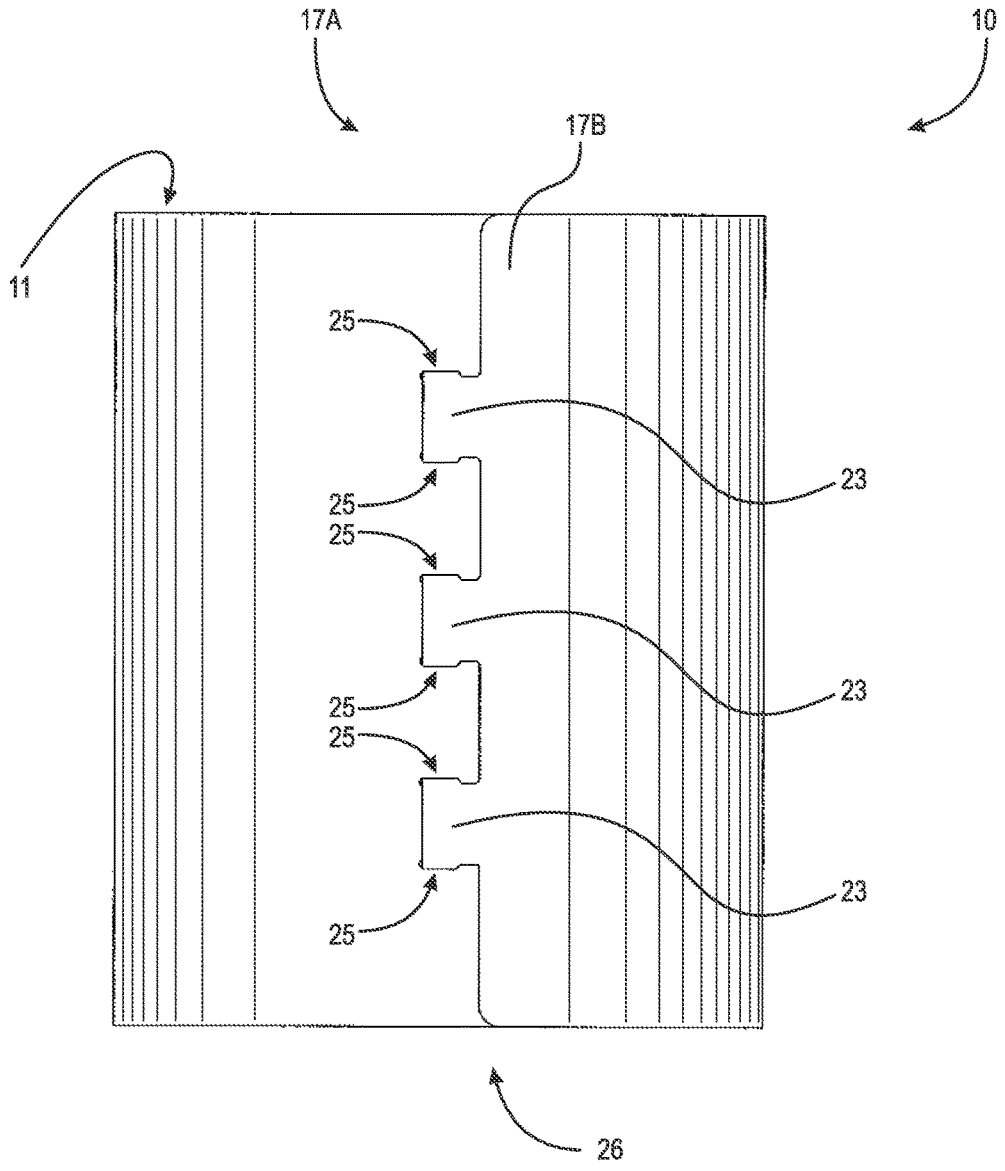
FIG. 3 is a rear view of the target receptacle shown in FIG. 1.

The rear of target receptacle 10 is shown in FIG. 3. When rolled together, target receptacle 10 is secured by tabs 23 and gaps 25. Gaps 25 are arranged proximate first end 17A of target receptacle 10. Preferably, gaps 25 are parallel to one another. Tabs 23 are arranged proximate second end 17B. Gaps 25 are arranged to receive tabs 23. In the preferred embodiment, there are six gaps 25 and three tabs 23. More specifically, the top-most two gaps 25 are arranged to receive the top-most tab 23. The middle two gaps 25 are arranged to receive the middle tab 23. Similarly, the bottom-most two gaps 25 are arranged to receive the bottom-most tab 23. It should be appreciated that there could be additional or fewer tabs 23 and gaps 25. Additionally, tabs 23 could be any shape such that tabs 23 removably engage gaps 25. Similarly, gaps 25 could be any shape such that gaps 25 removably receive tabs 23. Tabs 23 protrude from second end 17B of target receptacle 10 and into gaps 25. Preferably, tabs 23 are substantially "T"-shaped such that the upper and lower extensions 23A (not shown) engage gaps 25. The distance between the upper-most end of each tab 23 and the lower-most end of each tab 23 is greater than the distance between their respective gaps 25. Tabs 23 are biased open such that when tabs 23 are squeezed inward and placed into gaps 25, tabs 23 spring open automatically to engage inner wall 11. Unless tabs 23 are pulled from gaps 25, tabs 23 remain coupled with gaps 25. Tabs 23 are arranged to be inserted into gaps 25 by a user to form the cylindrical target receptacle 10. Hereinafter, gaps 25 and tabs 23 when engaged will be referred to as seam 26. It should be appreciated that tabs 23 and gaps 25 are the preferred means for securing target receptacle 10. However, any means of securing target receptacle 10 in a cylindrical shape, or other suitable shape, can be used, for example, hook and loop fasteners or snap buttons.

Figure 4:
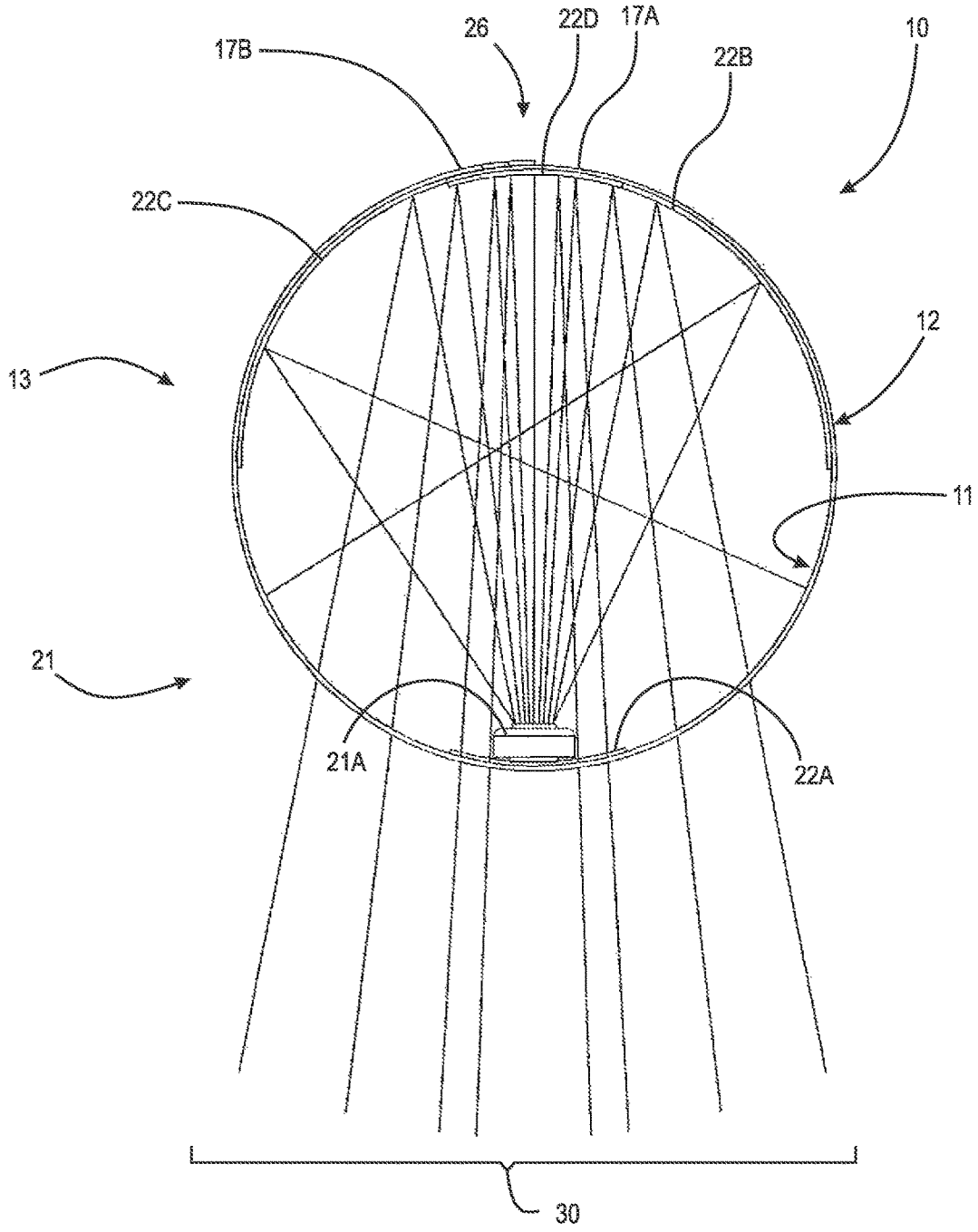
FIG. 4 is a top view of the target receptacle shown in FIG. 1 showing the illumination means interacting with the reflective members of the invention by way of representative light rays.

FIG. 4 depicts a top view of target receptacle 10. Top 13 of target receptacle 10 is open. As described above, seam 26 is formed by side 17A adjoined with side 17B by tabs 23 (not shown) and gaps 25 (not shown). Illumination assembly means 21 comprises light source 21A fixedly secured to target receptacle 10 diametrically opposite seam 26. Further, illumination assembly means 21 comprises first, second, third and fourth reflective members 22A, 22B, 22C, and 22D, respectively. First reflective member 22A is secured to inner wall 11 proximate light source 21A. First reflective member 22A is located between light source 21A and inner wall 11. Second reflective member 22B is secured to inner wall 11 proximate first end 17A. Third reflective member 22C is secured to inner wall 11 proximate second end 17B. Fourth reflective member 22D is secured to inner wall 11 proximate seam 26. Preferably, inner wall 11 is black and reflective members 22A, 22B, 22C, and 22D are reflective white. Target receptacle 10 could also have a white reflective inner wall 11 in which case reflective members 22A, 22B, 22C and 22D would not be necessary. Alternatively, target receptacle 10 could be made of a translucent or a transparent material. FIG. 4 also depicts sample rays 30. It should be appreciated that sample rays 30 represent three types of light rays that can occur in an infinite number of ways. For example, some rays 30 will be absorbed by the non-reflective surface of inner wall 11 of target receptacle 10. Other rays 30 will be transmitted from light source 21A, bounce off reflective members 22B, 22C, and/or 22D opposite light source 21A and exit target receptacle 10 through aperture 18 (not shown) and/or open top 13. Still other rays 30 originating from light source 21A will bounce off at least one reflective member 22B, 22C, 22D opposite light source 21A, then bounce off first reflective member 22A surrounding light source 21A, and then exit target receptacle 10 through aperture 18 (not shown) and/or open top 13. It should be appreciated that the light emitted by light source 21A appears as a glow rather than individualized rays.

Figure 5:
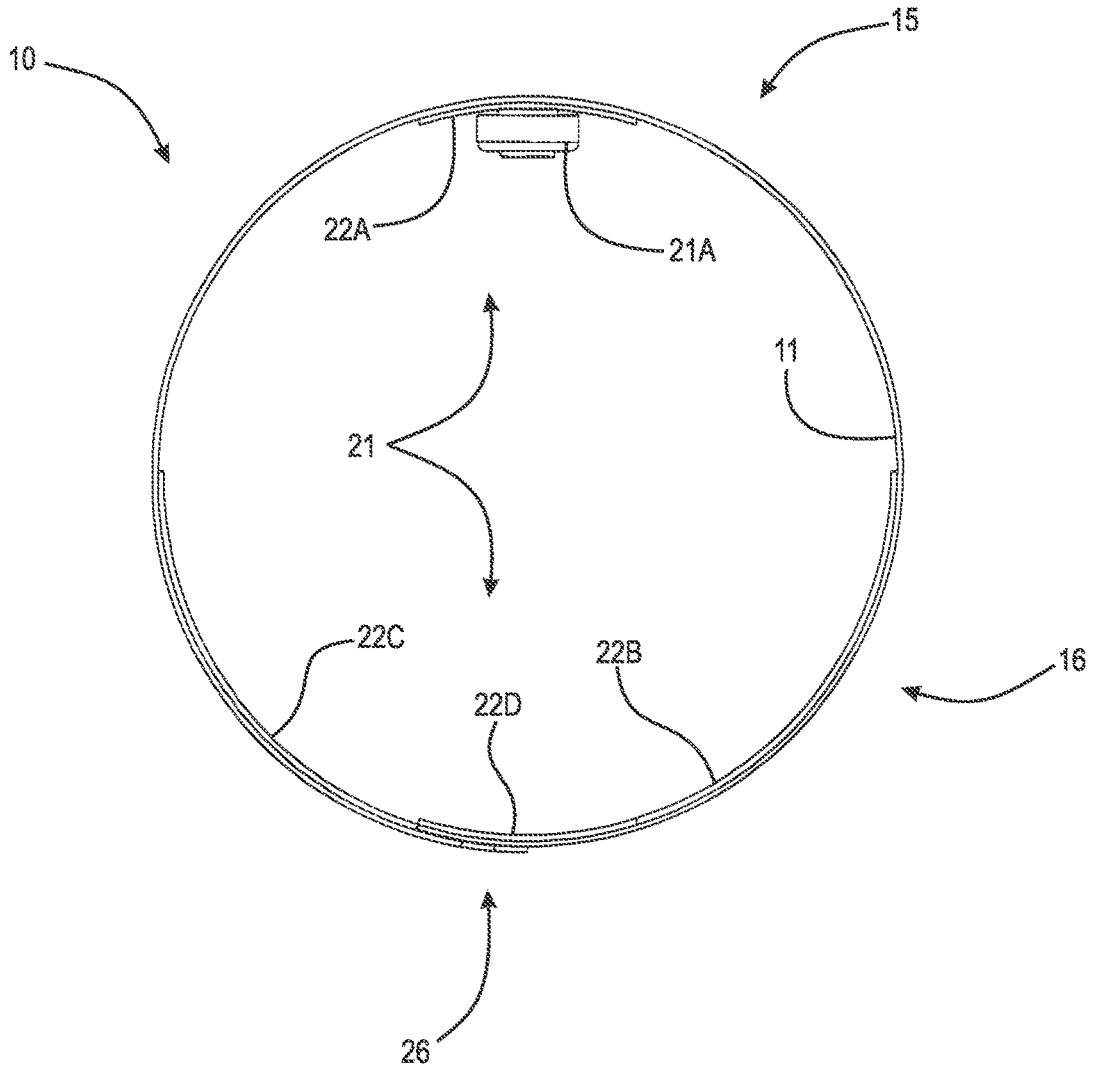
FIG. 5 is a bottom view of the target receptacle shown in FIG. 1.

A bottom view of target receptacle 10 and illumination assembly means 21 is shown in FIG. 5. Rays 30 are not illustrated. First reflective member 22A is arranged between light source 21A and inner wall 11 of target receptacle 10. For purposes of illustration, first, second, third, and fourth reflective members 22A, 22B, 22C, and 22D are visible from this view; however, it should be appreciated that reflective members 22A, 22B, 22C, and 22D are rather thin and may not be as noticeable from the top and bottom views when adhered to inner wall 11. Second reflective member 22B is shown secured to inner wall 11. Adjacent to second reflective member 22B, third and fourth reflective members 22C, 22D are secured to inner wall 11. Fourth reflective member 22D is positioned between second and third reflective members 22B, 22C proximate seam 26. Light source 21A is opposite seam 26 and fourth reflective member 22D. Second and third reflective members 22B, 22C are arranged at an angle from light source 21A. Second, third, and fourth reflective members 22B, 22C, and 22D are all arranged along rear 16 of target receptacle 10 opposite front 15 of target receptacle 10 when target receptacle 10 is rolled together.

Figure 6:
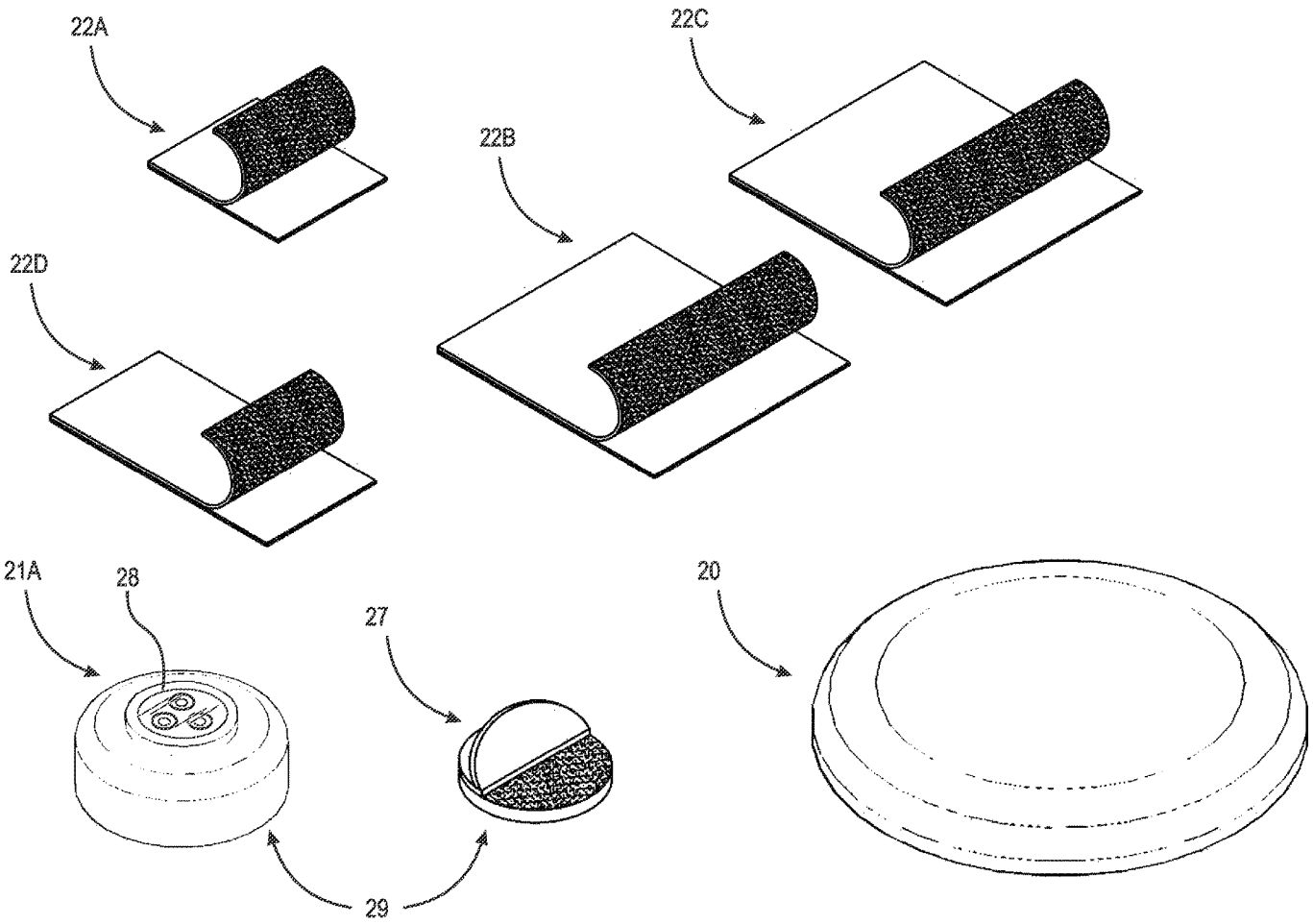
FIG. 6 is a view of the components of an illumination means according to the invention including reflective members, a light source, and a throwing disc.

FIG. 6 depicts the elements of illumination assembly means 21 as shown and described in FIGS. 1 through 5. In order to activate illumination assembly means 21, a user fixedly secures reflective members 22A, 22B, 22C, and 22D to inner wall 11 of target receptacle 10 (not shown). Each reflective member 22A, 22B, 22C, and 22D comprises an adhesive side which is protected by peel off backing. The adhesive sides of reflective members 22A, 22B, 22C, and 22D, when exposed for placement, are applied to inner wall 11 (not shown). The non-adhesive sides of reflective members 22A, 22B, 22C, and 22D are reflective white and arranged to transmit light from light source 21A. The non-adhesive sides, or reflective sides of reflective members 22B, 22C, and 22D face non-adhesive side, or reflective side of reflective member 22A. Preferably, first reflective member 22A is rectangular and measures approximately 6 inches long by approximately 5 inches high. Second and third reflective members 22B, 22C are also rectangular and measure approximately 9 inches long by approximately 10 inches high. Second and third reflective members 22B, 22C are substantially similar. Fourth reflective member 22D is also rectangular and measures approximately 5 inches long by approximately 10 inches high.

Illumination assembly means 21 further comprises light source 21A secured to inner wall 11 of target receptacle 10 (not shown). Light source 21A is secured by fastener 27. Fastener 27 includes one side with fastening means 29 preferably made of hook and loop fastener to hold light source 21A. Fastener 27 further includes another side which includes a strong adhesive protected by peel off backing. Light source 21A comprises housing button 28, a removable back, a plurality of light-emitting diodes (LEDs), and a plurality of batteries, preferably three batteries having a size of AAA, arranged to power the LEDs. The removable back of light source 21A comprises fastening means 29, also preferably made of hook and loop fastener, arranged to engage fastening means side 29 of fastener 27. Fastening means 29 of light source 21A is arranged approximately in the center of the removable back of light source 21A. The removable back of light source 21A is removable by a typical twist and lock mechanism. When coupled, the removable back is in the locked position. Additionally, the removable back of light source 21A can include screws, preferably three, to further secure the removable back to light source 21A. Any suitable number of screws in any suitable arrangement, for example, a triangular arrangement, could suffice. To remove the removable back, the back is twisted to the unlocked position and pulled away from the housing button 28. Batteries can be installed and replaced when the removable back is pulled away. In order to secure light source 21A to inner wall 11 (not shown), a user removes the peel off backing of fastener 27 and positions fastener 27 approximately in the center of first reflective member 22A arranged on inner wall 11 (not shown). Light source 21A can be removably secured to fastener 27 by means of the hook and loop material arranged on both the back of light source 21A and fastener 27. The LEDs arranged within light source 21A are preferably green because it is the color that is easiest to perceive by people but, it should be appreciated that the LEDs could be any color or could be LEDs that change color. Further, it should be appreciated that light source 21A can be set to flash. Additionally, in the preferred embodiment, light source 21A comprises three LEDs but, it could comprise additional or fewer LEDs. The three LEDs of the preferred light source 21A are arranged in a triangular pattern. However, again it should be appreciated that the LEDs could be arranged in any suitable pattern. It should be appreciated that light source 21A can take any form, including incandescent light bulbs, fluorescent light bulbs, or glow sticks. Additionally, while the preferred fastener 27 is a hook and loop fastener, fastener 27 can include sticky adhesives, clips, or any other suitable attachment means. Once light source 21A is attached to inner wall 11 (not shown), the LEDs can be activated when housing button 28 is pressed. Housing button 28 is located on the top of light source 21A proximate LEDs. Housing button 28 is transparent to allow light emitted from the LEDs to pass from light source 21A. Light source 21A functions as a standard push light.

In another embodiment of the present invention, target receptacle 10 (not shown) can be lined with fiber optics. For example, fiber optics could line the perimeter of aperture 18 and/or top 13 (not shown). In this embodiment, target receptacle 10 (not shown) can include reflective members 22A, 22B, 22C, and 22D. Furthermore, in other embodiments, light source 21A or fiber optics could be placed on outer wall 12 or bottom 14 (not shown).

Figure 13:
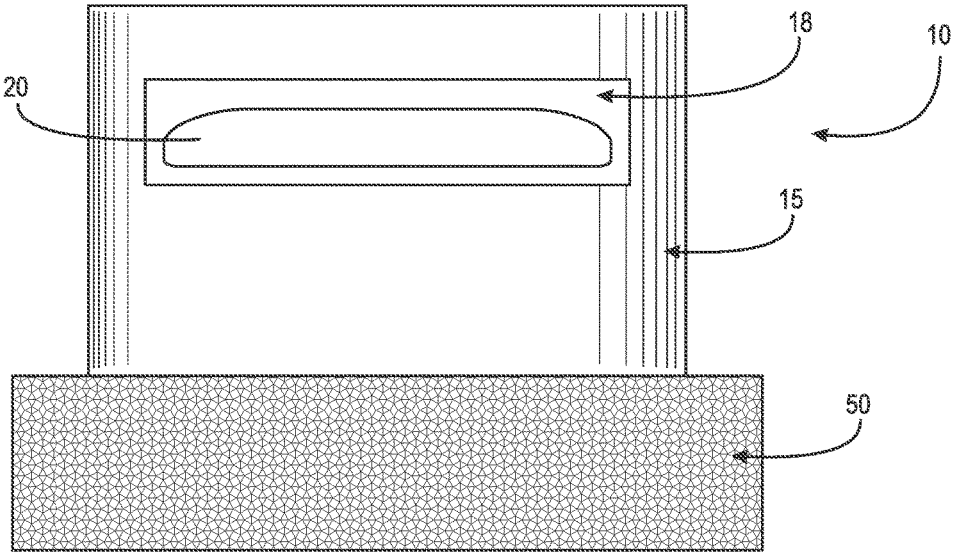
FIG. 13 is a front view of the target receptacle shown in FIG. 9 including a disc-shaped gliding object.

FIG. 6 further depicts disc-shaped gliding object 20 of illumination assembly means 21. Disc-shaped gliding object 20 is made of plastic and is arranged for gliding through the air when thrown. Additionally, disc-shaped gliding object 20 is photo luminescent. Further, disc-shaped gliding object 20 displays phosphorescent properties. In order to excite the phosphorescent properties, a user holds disc-shaped gliding object 20 under a bright light for about two minutes. Disc-shaped gliding object 20 charges while being exposed to bright light, and will glow in the dark for several hours after being removed from the light. Disc-shaped gliding object 20, in its preferred embodiment, is made of polypropylene. However, disc-shaped gliding object 20 could also be constructed of rubber, metal, or other lightweight malleable materials. Further, disc-shaped gliding object 20 could also have battery-powered LEDs. Disc-shaped gliding object 20 could be any size. In one embodiment, disc-shaped gliding object 20 is approximately 4.85 inches in diameter. In another embodiment, disc-shaped gliding object 20 is approximately 11 inches in diameter. In the preferred embodiment, the diameter of disc-shaped gliding object 20 is smaller than aperture 18 (as shown in FIG. 13). A smaller disc-shaped gliding object 20 is suitable for target receptacle 10 having flotation means 50. A larger disc-shaped gliding object 20 is suitable for target receptacle 10 having illumination means 21 without flotation means 50.

Figure 7:
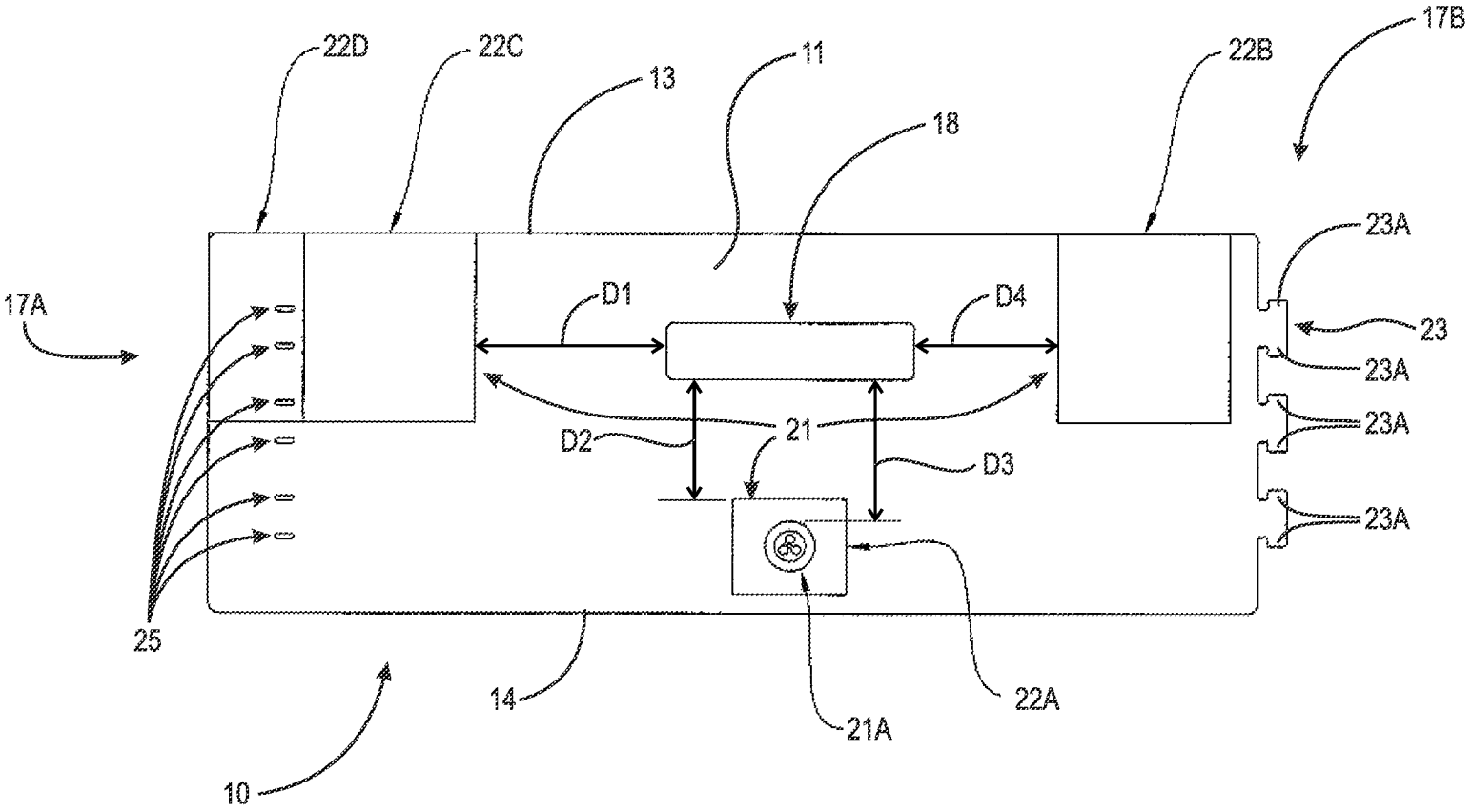
FIG. 7 is a top view of the target receptacle according to the invention in a flattened state showing the reflective members and the light source shown in FIG. 6 affixed.

FIG. 7 depicts target receptacle 10 flattened. Illumination assembly means 21 is affixed to inner wall 11 of target receptacle 10. From left to right, gaps 25, arranged parallel to one another and in registration with tabs 23, are arranged along first end 17A of target receptacle 10. Fourth reflective member 22D is arranged proximate first end 17A and covers a portion of gaps 25. In order to allow tabs 23 to engage with gaps 25, a user can trim/cut out or puncture fourth reflective member 22D proximate covered gaps 25. Third reflective member 22C is arranged to the right of fourth reflective member 22D. It should be appreciated that third and fourth reflective members 22C, 22D have approximately the same height. Fourth reflective member 22D is narrower than third reflective member 22C. Aperture 18 is arranged approximately in the center of flattened target receptacle 10 between first and second ends 17A, 17B. Aperture 18 is arranged distance D1 from reflective member 22C. Preferably, aperture 18 is positioned closer to top 13 than bottom 14. First reflective member 22A is positioned below aperture 18. Preferably, first reflective member 22A is approximately 1 inch from bottom 14. Aperture 18 is arranged distance D2 from reflective member 22A. Light source 21A is arranged approximately in the center of first reflective member 22A by means of fastener 27 (not shown). Aperture 18 is arranged distance D3 from light source 21A. Second reflective member 22B is arranged proximate second side 17B and tabs 23. Aperture 18 is arranged distance D4 from second reflective member 22B. Second reflective member 22B is substantially similar to third reflective member 22C. It should be appreciated that the reflective members and the light source are arranged around aperture 18 but their arrangement is not limited to the arrangement shown. In other words, the reflective members and/or the light source can be closer to or further away from aperture 18. Additional or fewer reflective members or light sources are contemplated. As described above, tabs 23 are substantially "T"-shaped and each tab 23 comprises an upper and lower extension 23A to engage gaps 25.

Figure 8:
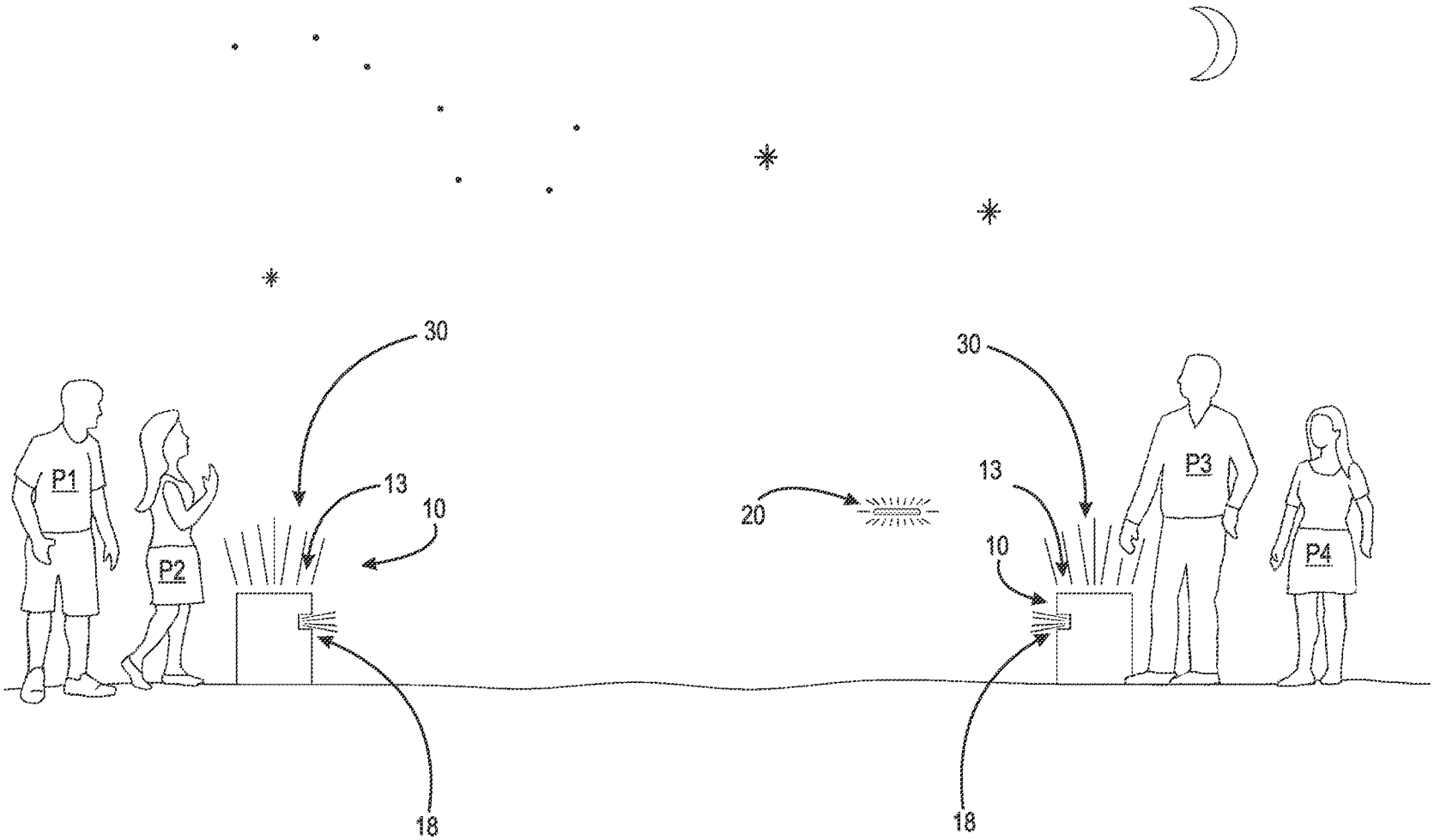
FIG. 8 is an environmental view of the illuminated disc throwing assembly in use on land.

FIG. 8 depicts light rays 30 emanating from illumination assembly means 21 (not shown), which enables a user to participate in a disc throwing game at night. Four players (P1, P2, P3, and P4) are divided into teams of two. Two target receptacles 10 are placed a distance apart. Members of the same team stand at opposite goals. With illumination assembly means 21 activated, represented by light rays 30, each player can visualize target receptacles 10 at night. Each player takes turns throwing disc-shaped gliding object 20 at target receptacle 10 arranged opposite the player. Each throw is scored one, two, or three points. Additionally, a player can win instantly by throwing disc-shaped gliding object 20 through aperture 18.

A disc throwing game including the components described herein can be played by two teams of two. However, it should also be appreciated that the game can be played by two opposing teams, each team having only a single player. In an example embodiment, a disc throwing game can be played by only two players, a first player and a second player P1 and P3, respectively or P2 and P4, respectively, for example. The method of such play involves the steps of: (a) arranging first receptacle 10 and a second receptacle 10 a distance apart wherein the receptacles 10 and 10 face each other and each of the receptacles 10 and 10 includes aperture 18 and 18 and open top 13 and 13; (b) positioning first player P1 or P2 behind first receptacle 10 and second player P3 or P4 behind second receptacle 10; (c) throwing disc-shaped gliding object 20 at first receptacle 10 by second player P3 or P4; (d) tallying at least one point based on the throw by second player P3 or P4 if disc-shaped gliding object 20 hits first receptacle 10 directly; (e) declaring second player P3 or P4 a winner based on the throw by second player P3 or P4 if disc-shaped gliding object 20 lands inside first receptacle 10; (f) throwing disc-shaped gliding object 20 at second receptacle 10 by first player P1 or P2; (g) tallying at least one point based on the throw by first player P1 or P2 if disc-shaped gliding object 20 hits second receptacle 10 directly; (h) declaring first player P1 or P2 a winner based on the throw by first player P1 or P2 if disc-shaped gliding object 20 lands inside receptacle 10; and, (i) repeating steps (c) through (h) in alternating fashion until a player wins. It should be appreciated that disc-shaped gliding object 20 can hit, or make contact with, receptacle 10 on inner surface 11 or outer surface 12. Additionally, it should be appreciated, that disc-shaped gliding object 20 can land inside receptacle 10 through aperture 18 or open top 13.

Figure 9:
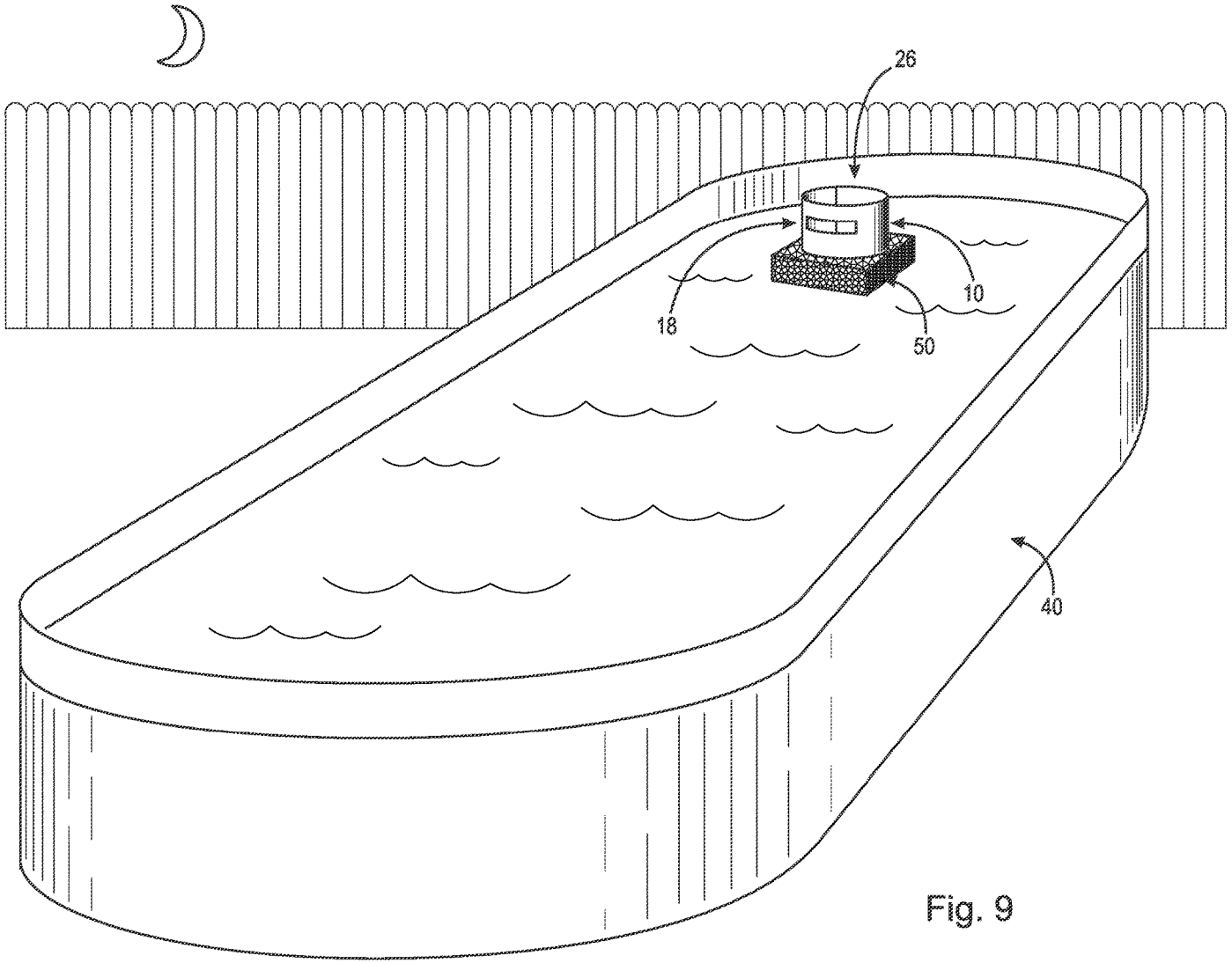
FIG. 9 is an environmental view of a target receptacle of the invention including a flotation means attached so that the target receptacle can float.
Figure 10:
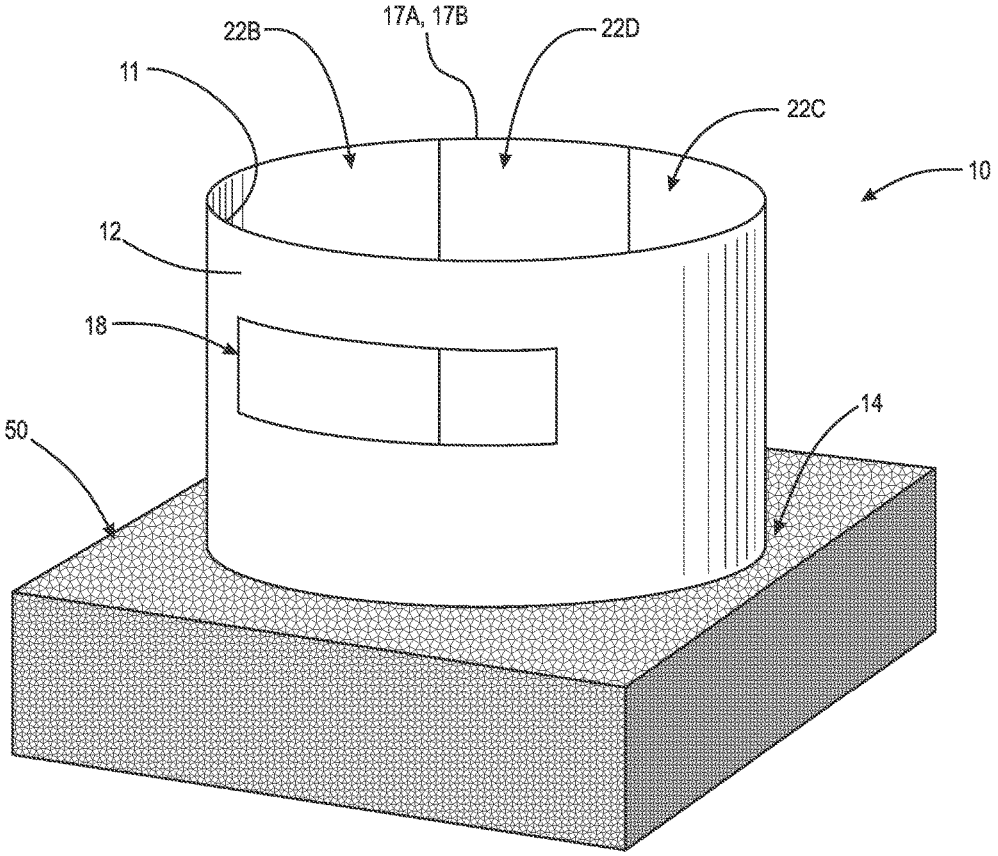
FIG. 10 is a perspective view of the target receptacle shown in FIG. 9.

FIG. 9 is a perspective view that depicts target receptacle 10 having flotation means 50 in pool 40. In a preferred embodiment, there would be two target receptacles 10 and two to four players P1, P2, P3, and P4 shown in pool 40 (not shown for simplicity). Flotation means 50 allows target receptacle 10 to float, permitting game play in pool 40, in a lake, or in any other body of water. It should be appreciated that illumination assembly means 21 (not shown) can be used with target receptacle 10 having flotation means 50 to permit night-time play in the water. Also depicted are aperture 18 and seam 26 of target receptacle 10. FIG. 10 depicts target receptacle 10 having flotation means 50. As described above, target receptacle 10 comprises aperture 18, inner wall 11, outer wall 12, first end 17A, and second end 17B. First and second ends 17A, 17B are secured together and form seam 26. First end 17A has gaps 25 (not shown) and second end 17B has tabs 23 (not shown). When the wall of target receptacle 10 is rolled, gaps 25 and tabs 23 (not shown) can be secured to form a cylinder. Further, bottom 14 of target receptacle 10 comprises protrusions 24 (not shown, described below) arranged to removably engage flotation means 50. Flotation means 50 is removable from target receptacle 10 to ensure the floatable disc throwing game is highly portable. Further, reflective members 22B, 22C, and 22D are shown attached to target receptacle 10. Reflective members 22B, 22C, and 22D are part of the illumination assembly means 21 (not shown), which enables gameplay in pool 40 (not shown) at night.

Flotation means 50 facilitates the floating of target receptacle 10 in water in a pool 40 (not shown) or some other body of water. In its preferred embodiment, flotation means 50 is constructed of high-density polyethylene (HDPE). One embodiment of flotation means 50 has a density range of 1.4-1.8 lb/ft$^2$, a cell size of 1.2 mm, and a water absorption less than 0.1 lb/ft$^2$. Any material encompassing these or similar qualities can be used to support target receptacle 10. For example, flotation means 50 could be constructed of a polyvinyl chloride toroidal ring, a laminated polyethylene foam, or a phthalate-free polyvinyl chloride toroidal ring or any other suitable shape. Further, flotation means 50 could be constructed of a plastic toroidal ring, or a closed-cell polystyrene foam.

Figure 11:
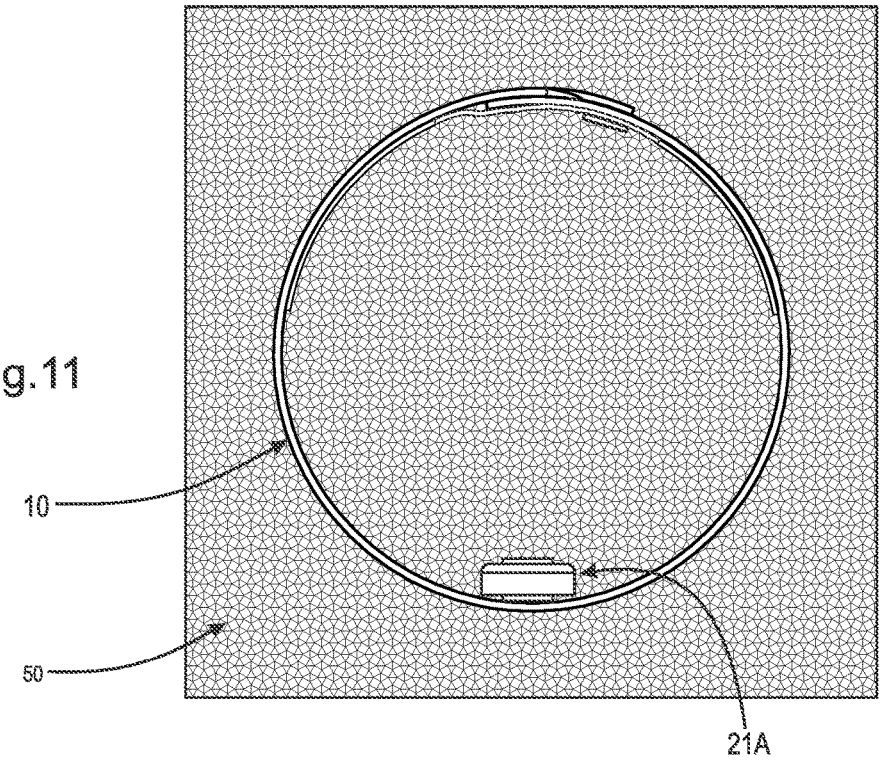
FIG. 11 is a top view of the target receptacle shown in FIG. 9.
Figure 12:
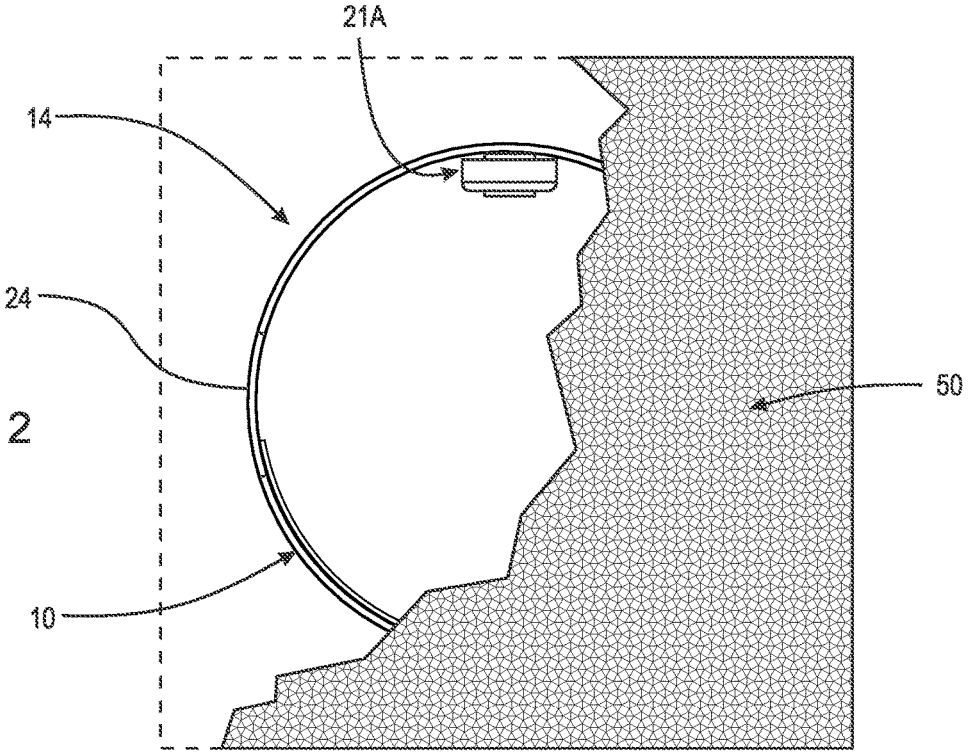
FIG. 12 is a bottom view of the target receptacle shown in FIG. 9 with the flotation means partially cut away.

FIG. 11 depicts the top view of target receptacle 10 having flotation means 50 as described herein. Bottom 14 of target receptacle 10 has protrusions 24 (not visible) that fit into slots 35 (not shown) in flotation means 50. Protrusions 24 and slots 35 (not shown) provide a removably secure engagement means for target receptacle 10 and flotation means 50. Light source 21A is part of the illumination assembly means 21 (not shown), which enables gameplay in pool 40 (not shown) at night. FIG. 12 depicts the bottom view of target receptacle 10 having flotation means 50. Flotation means 50 is partially cut away to show the position of target receptacle 10 in relation to flotation means 50. Target receptacle 10 could have one or more protrusions 24 to secure flotation means 50. In one embodiment, target receptacle 10 has two protrusions 24; one protrusion 24 arranged diametrically opposite another protrusion 24 (not shown). It should be appreciated that there could be more than two protrusions 24. Additionally, it should be appreciated that protrusions 24 do not have to be arranged along bottom 14 proximate where front 15 meets rear 16. Instead, protrusions 24 could be in any pattern along bottom 14. For example, protrusions 24 could be arranged proximate corners of flotation means 50 for stability. In an alternate embodiment, flotation means 50 could be cylindrical and secured to inner wall 12 of target receptacle 10 proximate bottom 14 using any suitable adhesive. In FIG. 12, only one protrusion 24 is visible where flotation means 50 is partially cut away. Protrusions 24 are rectangular in shape and arcuate; however, any shape which can removably engage slots 35 (not shown) can be used. Further, protrusions 24 protrude from bottom 14 of target receptacle 10. Light source 21A is part of the illumination assembly means 21 (not shown), which enables gameplay in pool 40 (not shown) at night.

FIG. 13 depicts the front view of target receptacle 10 having flotation means 50 and disc-shaped gliding object 20. Front 15 of target receptacle 10 has aperture 18. Flotation means 50 is wider than target receptacle 10.

Figure 14:
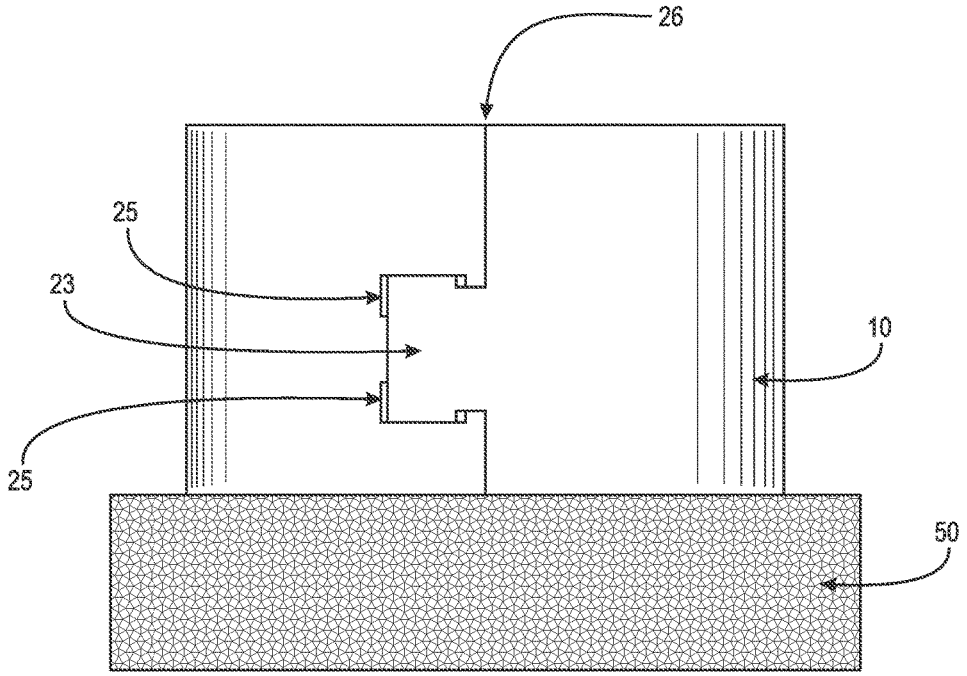
FIG. 14 is a rear view of the target receptacle shown in FIG. 9.

FIG. 14 shows a rear view of target receptacle 10 having flotation means 50 as shown in FIG. 13. Target receptacle 10 comprises one tab 23 and two gaps 25 to accommodate the extensions of tab 23. Again, it should be appreciated that in this embodiment target receptacle 10 could have more than one tab 23 and more than two gaps 25. When gaps 25 and tab 23 are engaged, seam 26 is formed. Flotation means 50 forms a rectangular prism. The combination of a rectangular floatation means 50 and cylindrical target receptacle 10 prevents the target from spinning in the water. It should be appreciated that flotation means 50 could take any other suitable shape to allow target receptacle 10 to float and prevent flotation means 50 from spinning. Preferably, flotation means 50 is wider than the diameter of cylindrical target receptacle 10; however, flotation means 50 could have the same circumference as target receptacle 10.

Figure 15:
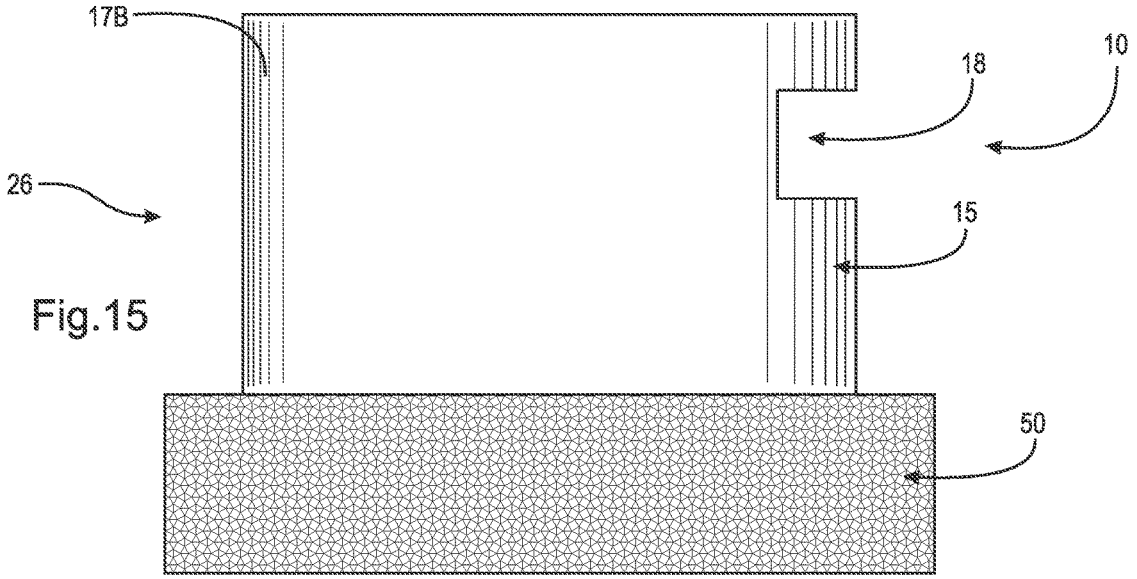
FIG. 15 is a left side view of the target receptacle shown in FIG. 9.
Figure 16:
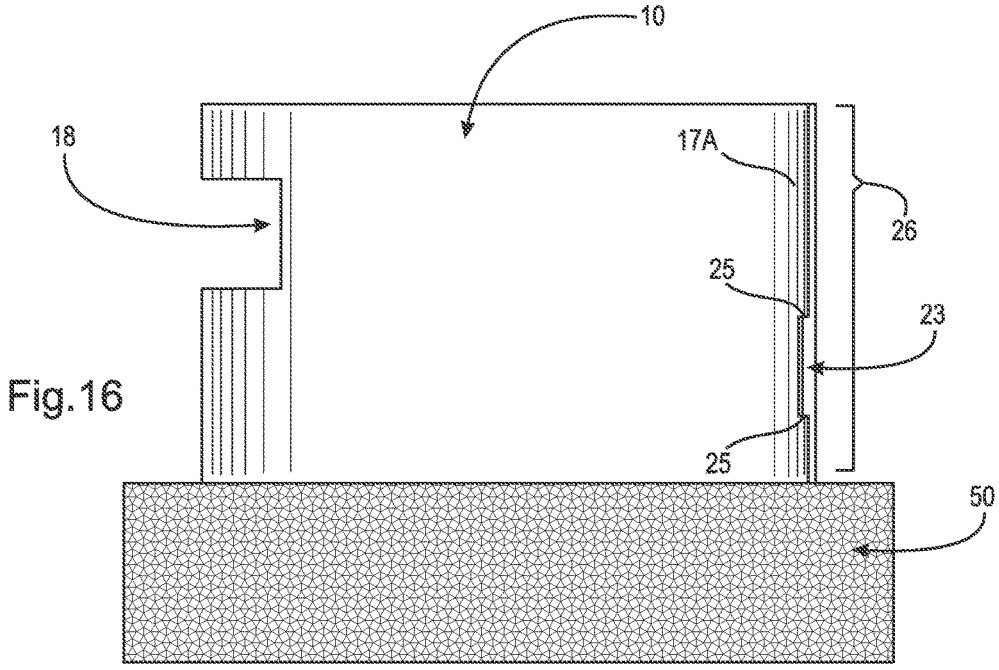
FIG. 16 is a right side view of the target receptacle shown in FIG. 9.

FIG. 15 depicts the left side of target receptacle 10 having flotation means 50. The curvature of aperture 18 located within front 15 of target receptacle 10 can be appreciated. Additionally, it should be appreciated that the diameter of target receptacle 10 is smaller than the width of flotation means 50. Seam 26 obstructs any view of tab 23 or gaps 25 (not shown) because first end 17A (not shown) is tucked behind second end 17B proximate tab 23 (not shown). FIG. 16 depicts the right side of target receptacle 10 with flotation means 50. From this view, first end 17A is shown. Further, tab 23 is shown protruding into gaps 25. When tab 23 and gaps 25 are engaged, seam 26 is formed. Also depicted is aperture 18 of target receptacle 10.

Figure 17:
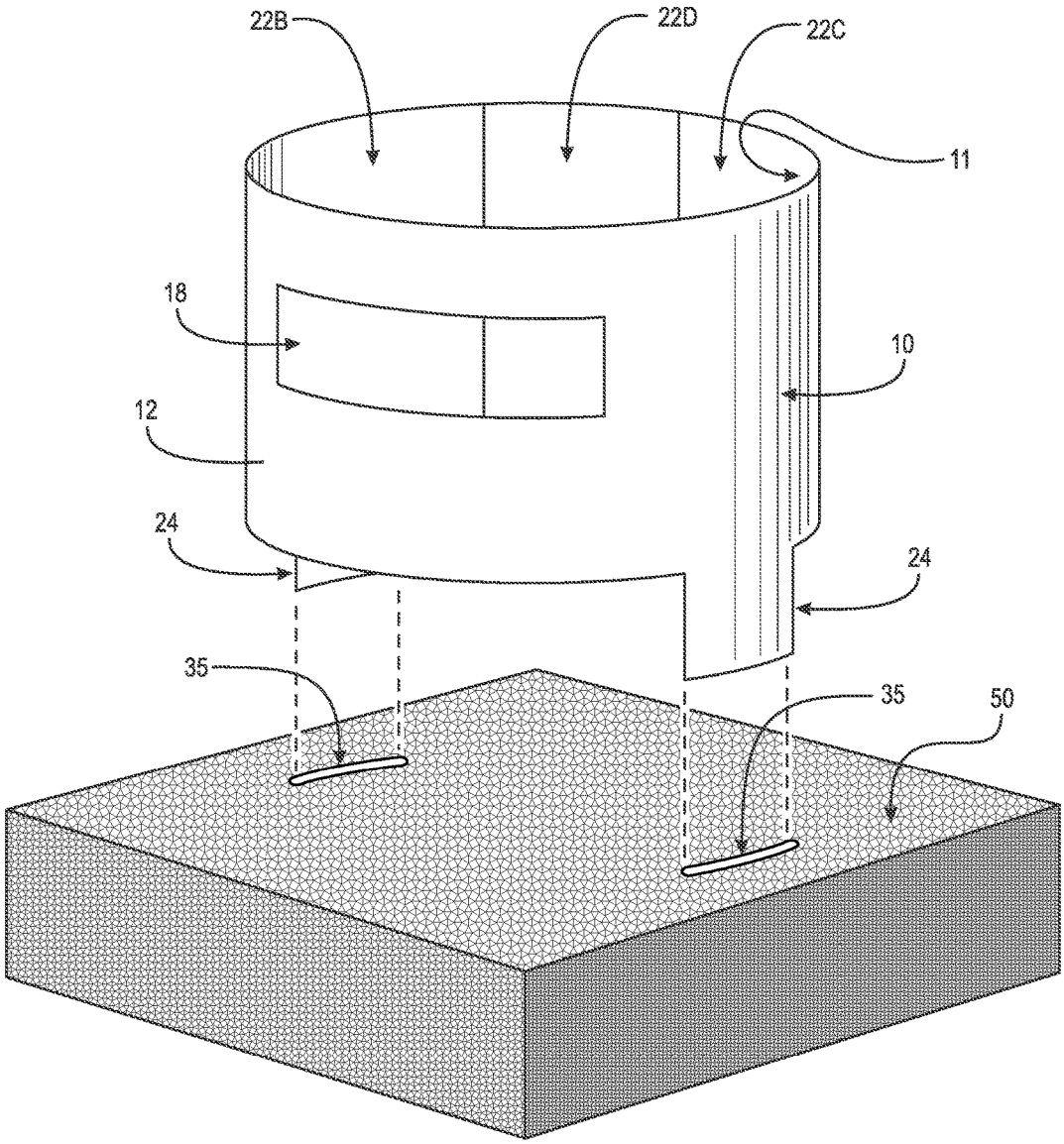
FIG. 17 is an exploded perspective view of the target receptacle shown in FIG. 9.

A partial exploded view of target receptacle 10 having flotation means 50 is shown in FIG. 17. Target receptacle 10 is removably attached to flotation means 50 by protrusions 24 and slots 35. Protrusions 24 are made of the same plastic film as target receptacle 10. Slots 35 are partial through-bores protruding into the laminated polyethylene foam of flotation means 50. Slots 35 receive protrusions 24. When slots 35 and protrusions 24 are engaged, inner wall 11 and outer wall 12 of target receptacle 10 are perpendicular to the top plane of flotation means 50. Other means of engaging target receptacle 10 and flotation means 50 can be used; for example, hook and loop fasteners, or strapping could engage target receptacle 10 and flotation means 50. Further, target receptacle 10 can be permanently attached to flotation means 50. Also depicted is aperture 18 of target receptacle 10. Further, reflective members 22B, 22C, and 22D are part of illumination assembly means 21 (not shown), which enables gameplay in pool 40 (not shown) at night.

Figure 18:
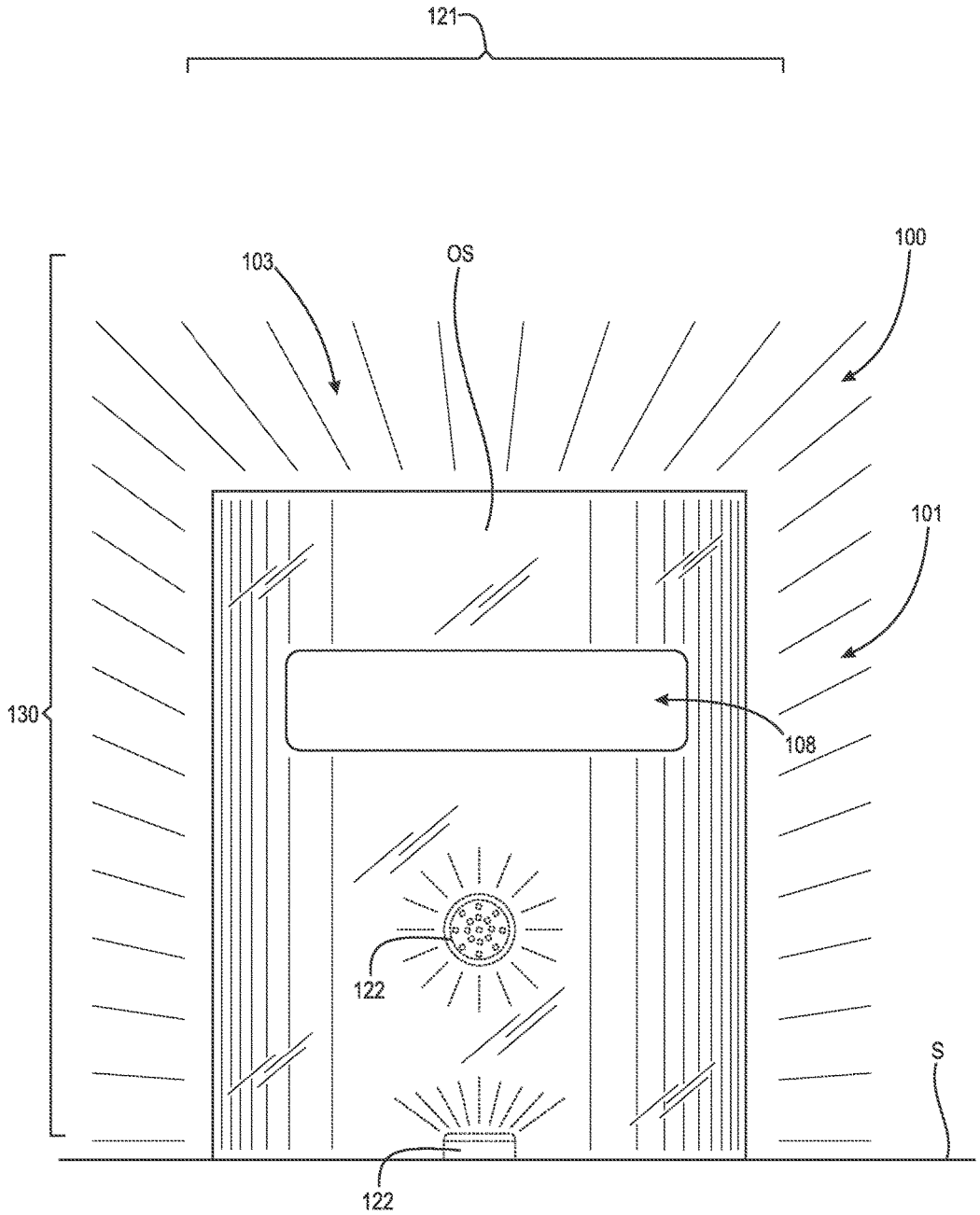
FIG. 18 is a front elevational view of another target receptacle according to the invention.

FIG. 18 is a front elevational view of target receptacle 100 including illumination assembly means 121.

Figure 19:
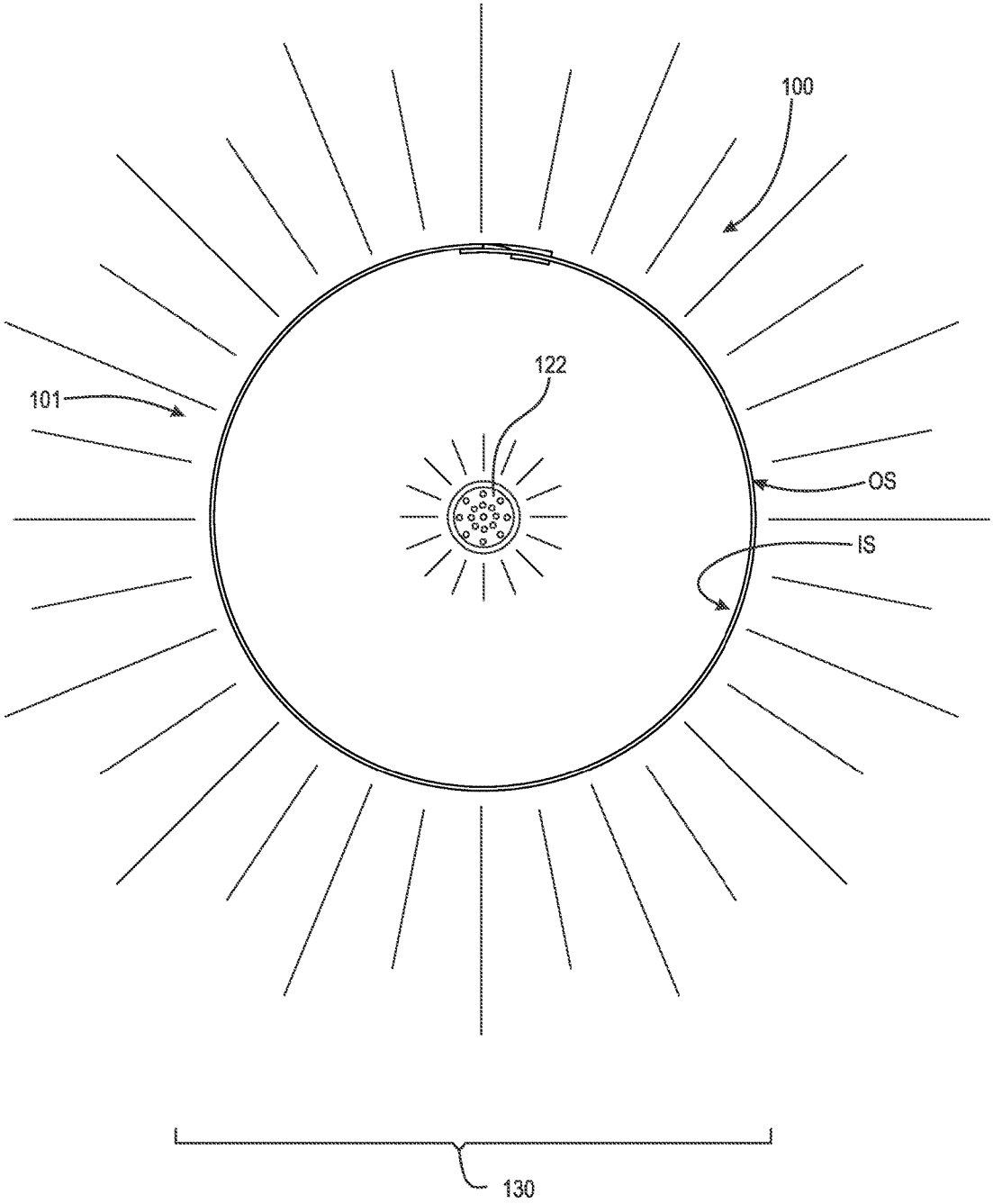
FIG. 19 is a top down view of the target receptacle shown in FIG. 18.

FIG. 19 is a top down view of target receptacle 100 of FIG. 18.

Figure 20:
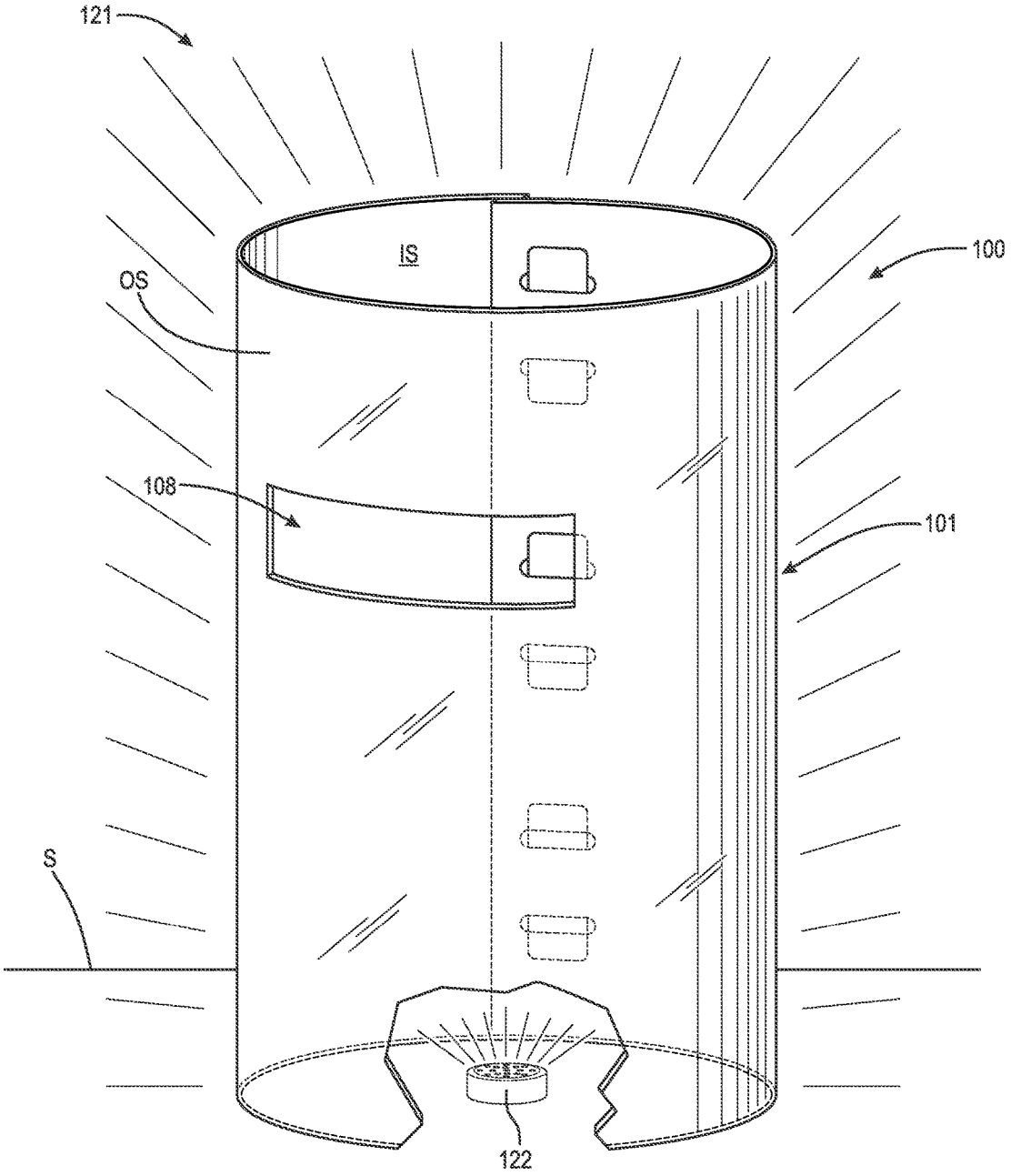
FIG. 20 is a perspective view of the target receptacle shown in FIG. 18 with a part of the receptacle cut away.

FIG. 20 is a perspective view of target receptacle 100 of FIG. 18 with a part of receptacle 100 cut away.

Figure 21:
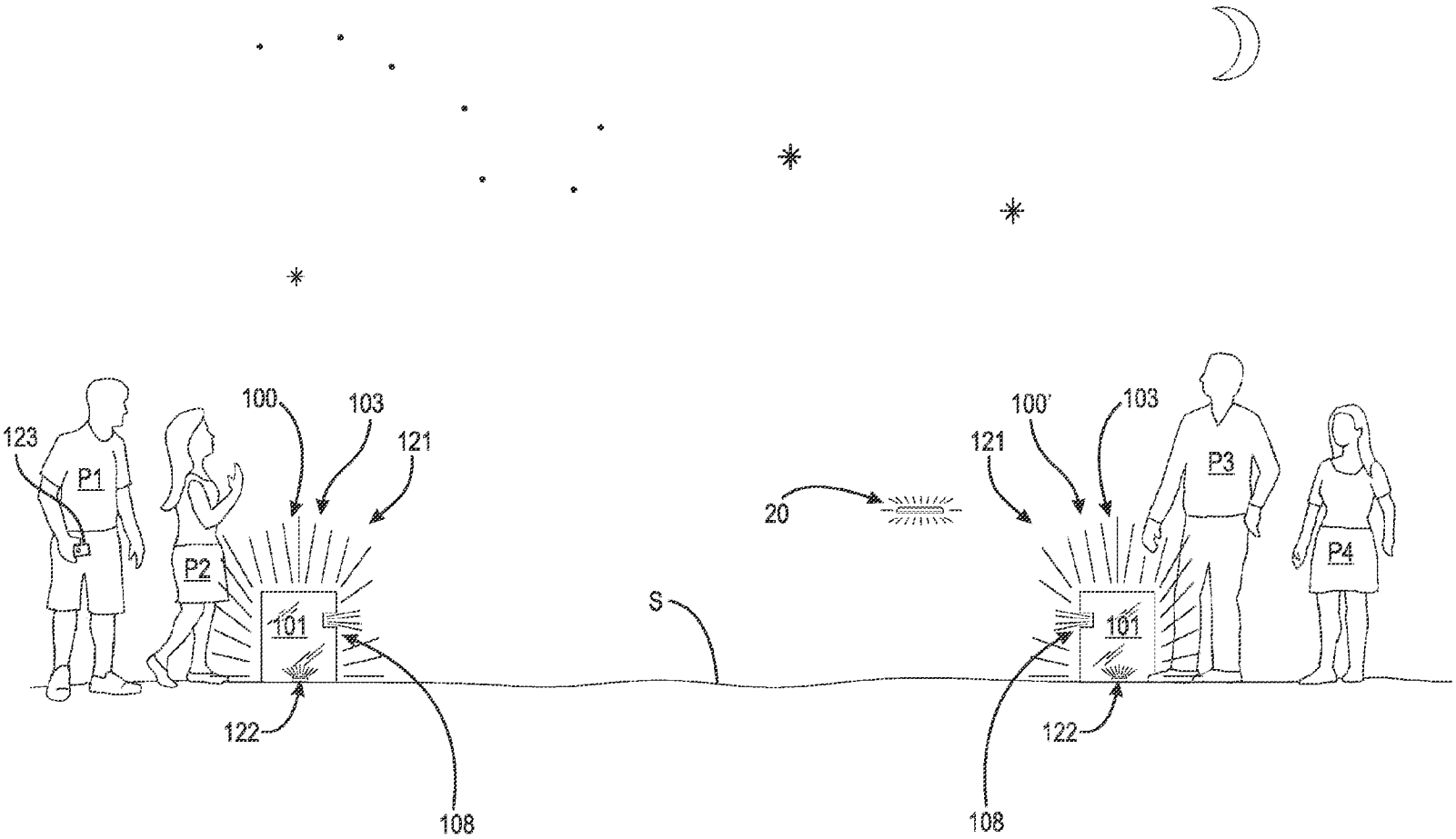
FIG. 21 is an environmental view of two target receptacles like the one shown in FIG. 18 in use on land; and, FIG. 22 is an environmental view of the two target receptacles shown in FIG. 21 in use in water.

FIG. 21 is an environmental view of two target receptacles 100, 100' in use on land.

Figure 22:
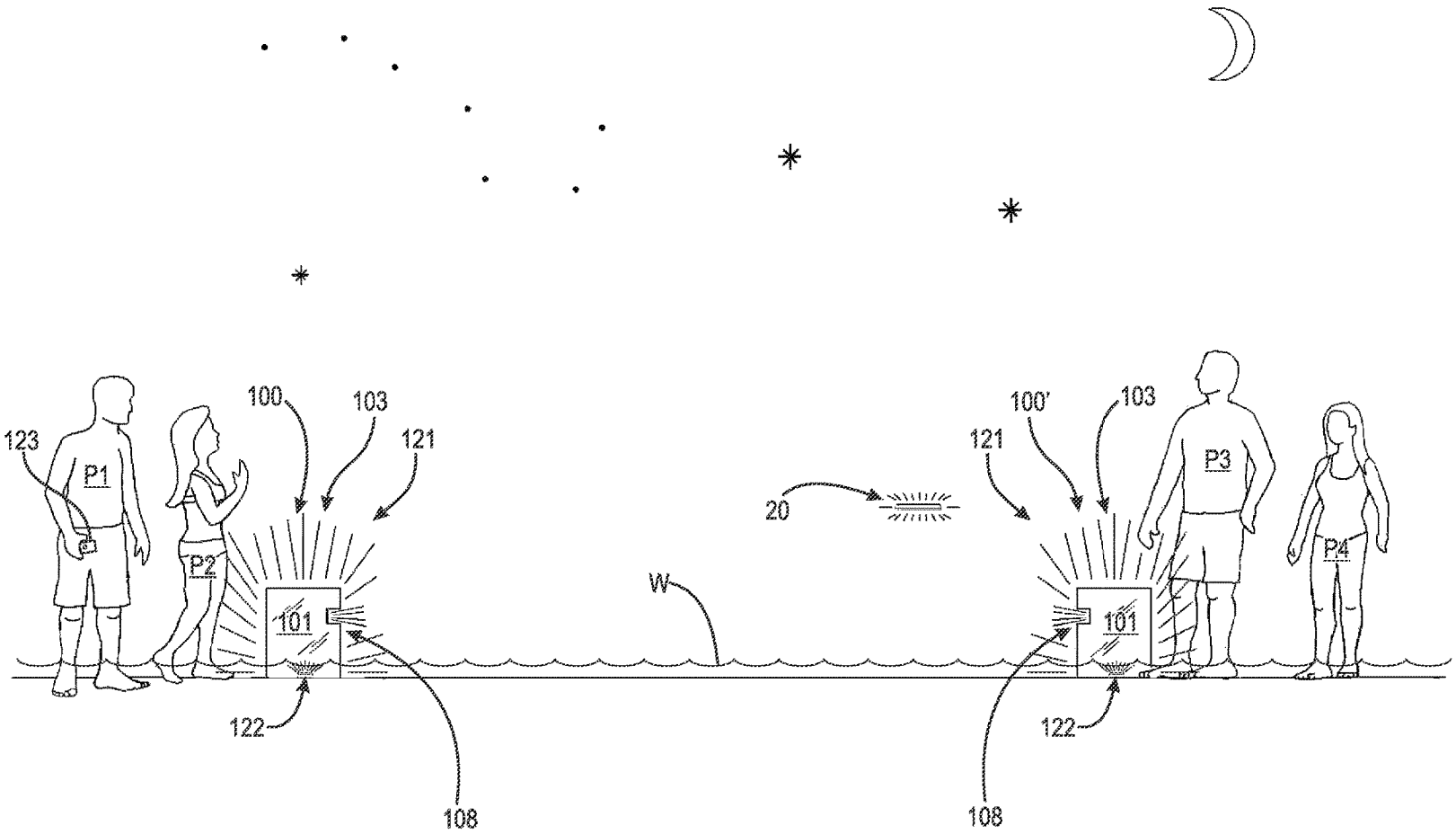

FIG. 22 is an environmental view of target receptacles 100, 100' of FIG. 21 in use in water W. The following should be viewed in light of FIGS. 18 through 22 and the discussion above pertaining to target receptacle 10 applies to target receptacle 100 except as noted below. Target receptacle 100 includes wall 101 including inside surface IS, outside surface OS and illumination assembly means 121. Illumination assembly means 121 can be placed on ground surface S upon which target receptacle 100 rests. Alternatively, illumination assembly means 121 can be secured to inside surface IS at any location along inside surface IS. When illumination assembly means 121 is activated within target receptacle 100, light emanates upwardly from open top 103, outwardly through aperture 108 and from wall 101. For purposes of illustration, rays 130 represent typical light rays that are emitted when illumination assembly means 121 is activated. It should be appreciated that the reflective members of target receptacle 10 are not necessary for target receptacle 100 since target receptacle 100 itself transmits light. In an example embodiment, target receptacle 100 is constructed of HDPE and of a color which substantially transmits and reflects light. For example, in a preferred embodiment, target receptacle 100 is a translucent white. Translucent target receptacle 100 can be made of natural, virgin, prime, off-grade or recycled HDPE. Target receptacle 100 can also be transparent to allow light to be transmitted from light illumination means 121 through wall 101 outwardly.

Illumination assembly means 121 can be any suitable device that transmits light from within target receptacle 100 outwardly through target receptacle 100. In a preferred embodiment, illumination assembly means includes remote-controlled device 122 containing LEDs. In a preferred embodiment, ten (10) LEDs are included in device 122 and can be illuminated in a single color or varying colors. Any suitable number of LEDs is contemplated for example, additional or fewer LEDs can be included in illumination assembly means 121. In an example embodiment, nine (9) LEDs are used. For example, using remote control 123, device 122 can be set to transmit continuous light or interrupted (or blinking/flashing) light. Device 122 can also be set to transmit different colors of light in a continuous series. For example, device 122 can illuminate blue, white, green, purple, pink, and orange light one after the other and repeat the series over and over again. Alternatively, device 122 can be set to illuminate only blue light, or white light, or green light by way of example. Device 122 can be powered by three (3) AAA batteries. Device 122 can be made of acrylonitrile-butadiene-styrene (ABS), or any suitable alternative, so that device 122 can be submerged in water, if desired. A suitable illumination assembly means 121 having a model number of IH-101M is available from Guangzhou Ihome Lighting Co., Ltd., located at Room 201, Ladder 1, Building 2, Cuiping Garden, East of Jinxiu Park, Panyu district in the province of Guangdong and the city of Guangzhou in China.

Advantageously, target receptacle 100 can be illuminated without applying additional reflective members on inside surface IS of target receptacle 100. It should be appreciated that illumination assembly means 121 can be used with target receptacle 10 as well in an embodiment where target receptacle 10 is translucent or transparent and no additional reflective members are necessary.

Thus, it is seen that the objects of the present invention are efficiently obtained, although modifications and changes to the invention should be readily apparent to those having ordinary skill in the art, which modifications are intended to be within the spirit and scope of the invention as claimed. It also is understood that the foregoing description is illustrative of the present invention and should not be considered as limiting. Therefore, other embodiments of the present invention are possible without departing from the spirit and scope of the present invention.

REFERENCE NUMERALS

10 Receptacle
11 Inner wall
12 Outer wall
13 Top
14 Bottom
15 Front
16 Rear
17A First end
17B Second end
18 Aperture
20 Disc-shaped gliding object
21 Illumination assembly means
21A Light source
22A First reflective member
22B Second reflective member
22C Third reflective member
22D Fourth reflective member
23 Tabs
23A Extensions
24 Protrusions
25 Gaps
26 Seam
27 Fastener
28 Housing button
29 Fastening means
30 Rays
35 Slots
40 Pool
50 Flotation means P1 Player
P2 Player
P3 Player
P4 Player
100 Target receptacle
100' Target receptacle
101 Sidewall
103 Open top
108 Aperture
S Ground surface
IS Inside surface
OS Outside surface
121 Illumination assembly means
122 Device
123 Remote
130 Rays
W Water
D1 Distance
D2 Distance
D3 Distance
D4 Distance

What is claimed is:

1. A disc throwing game assembly, comprising:

two target receptacles, each receptacle of the two receptacles having:

an open top;

an insider surface an open bottom connected to said open top, the open bottom having at least one protrusion extending downwardly therefrom;

at least one aperture arranged between said open top and said open bottom; and, an illumination means positionable within said receptacle, said illumination means operatively arranged to transmit light through said at least one aperture and said open top;

at least one flotation means including:

a top surface;

at least one slot arranged on the top surface, wherein the at least one protrusion is arranged to engage the at least one slot and secure one of the two receptacles to the at least one flotation means; and, a disc-shaped gliding object.

2. The target receptacle of claim 1, wherein at least one said receptacle is opaque.

3. The target receptacle of claim 1, wherein at least one said receptacle is translucent.

4. The target receptacle of claim 1, wherein at least one said receptacle is transparent.

5. The target receptacle of claim 1, wherein said illumination means includes a light source which includes at least one light-emitting diode.

6. The target receptacle of claim 1, wherein said illumination means includes a light source which is fiber optic.

7. The target receptacle of claim 1, wherein said illumination means includes at least one reflective member securable to said inside surface of said receptacle.

8. The target receptacle of claim 7, wherein said inside surface is black and said at least one reflective member is white.

9. The target receptacle of claim 1, wherein said illumination means comprises:

a light source securable to said inside surface of said receptacle; and, a plurality of reflective members securable to said inside surface of said receptacle, where a first reflective member of said plurality of reflective members is arranged between said light source and said inside surface of said receptacle.

10. The target receptacle of claim 9, wherein a second reflective member is securable to said inside surface at an angle from said light source.

11. The target receptacle of claim 10, wherein:

said first reflective member includes a first reflective surface; and, said second reflective member includes a second reflective surface arranged to face said first reflective surface when said first and second reflective members are secured to said inside surface of said receptacle.

12. The target receptacle recited in claim 1, wherein:

said at least one aperture is arranged closer to said open top than said open bottom; and, said illumination means includes a light source secured to said inside surface closer to said open bottom than said open top.

13. The target receptacle recited in claim 9, wherein said first reflective member is disposed proximate to and circumscribing said light source.

14. The target receptacle recited in claim 1, wherein said receptacle is a cylindrically-shaped target.

15. The target receptacle recited in claim 1, wherein said flotation means is constructed of laminated polyethylene foam.

16. The target receptacle recited in claim 1, wherein said flotation means is constructed of a high-density polyethylene.

* * * * *